US007905319B2

(12) United States Patent
Sullivan

(10) Patent No.: US 7,905,319 B2
(45) Date of Patent: Mar. 15, 2011

(54) VENTURI MUFFLER

(76) Inventor: John T. Sullivan, Marriottsville, MD (US)

( * ) Notice: Subject to any disclaimer, the term of this patent is extended or adjusted under 35 U.S.C. 154(b) by 106 days.

(21) Appl. No.: 12/155,879

(22) Filed: Jun. 11, 2008

(65) Prior Publication Data

US 2009/0308686 A1 Dec. 17, 2009

(51) Int. Cl.
*F01N 1/02* (2006.01)

(52) U.S. Cl. ..... 181/250; 181/212; 181/232; 181/247; 181/248

(58) Field of Classification Search ..... 181/250, 181/212, 273, 276, 278, 279, 232, 247, 248
See application file for complete search history.

(56) References Cited

U.S. PATENT DOCUMENTS

| | | | | | |
|---|---|---|---|---|---|
| 2,150,768 | A * | 3/1939 | Hedrick | 181/275 |
| 2,176,615 | A * | 10/1939 | Starkweather et al. | 181/250 |
| 2,502,709 | A * | 4/1950 | Dorman | 181/251 |
| 3,677,364 | A * | 7/1972 | Pawlina | 181/269 |
| 4,361,206 | A * | 11/1982 | Tsai | 181/255 |
| 4,673,863 | A * | 6/1987 | Swarbrick | 322/2 R |
| 5,269,132 | A * | 12/1993 | Loucks | 60/204 |
| 5,530,214 | A | 6/1996 | Morehead et al. | |
| 5,892,186 | A | 4/1999 | Flugger | |
| 5,952,625 | A | 9/1999 | Huff | |
| 6,089,347 | A | 7/2000 | Flugger | |
| 6,105,716 | A | 8/2000 | Morehead et al. | |
| 6,220,387 | B1 * | 4/2001 | Hoppes et al. | 181/259 |
| 6,832,665 | B2 * | 12/2004 | Crombeen | 181/275 |
| 7,243,757 | B2 | 7/2007 | Stuber | |
| 7,331,422 | B2 | 2/2008 | Wall | |
| 7,380,639 | B2 * | 6/2008 | Arlasky | 181/279 |
| 2007/0107982 | A1 * | 5/2007 | Sullivan | 181/249 |
| 2007/0151799 | A1 * | 7/2007 | Zuberi et al. | 181/256 |

* cited by examiner

*Primary Examiner* — Elvin G Enad
*Assistant Examiner* — Forrest M Phillips
(74) *Attorney, Agent, or Firm* — Miles & Stockbridge P.C.; David R. Schaffer, Esq.

(57) ABSTRACT

A venturi muffler is made of a plurality of metallic tubular stepped members which are stacked together and define at least one sound-reflective chamber which opens through an annular venturi passage into an axial flow passage of the venturi muffler thereby creating a partial vacuum in the annular chamber. The annular chambers include aligned openings through which exhaust gasses flow but are also reflected by walls of the sound-reflective chambers. Therefore, the exhaust sound or noise is dampened by the cancellation of sound waves 180 degrees out of phase with each other, the creation of a partial vacuum through which sound cannot propagate or propagates minimally, and by the heat removed by all of the metallic heat-conductive venturi-forming segments of the venturi muffler.

28 Claims, 18 Drawing Sheets

VENTURI MUFFLER

FIELD OF THE INVENTION

The present invention relates to mufflers for internal combustion engines.

BACKGROUND OF THE INVENTION

Internal combustion engines create noise which is generated by the sudden expansion of internal combustion engine chamber exhaust gasses. As the combustion gasses are exhausted from each cylinder of the engine, a sound wave front travels at rapid sonic velocities through the exhaust system. Efforts have continued over many years to reduce or muffle the noise caused by combustion gasses.

U.S. Pat. No. 5,952,625 granted on Sep. 14, 1999 to Ronald G. Huff describes two major muffler classifications, namely, dissipative and reactive mufflers. Dissipative mufflers are typically composed of ducts or chambers filled with acoustic materials, such as fiberglass, steel wool or porous ceramics. Such materials absorb acoustic energy and transform it into thermal energy. Reactive mufflers are composed of a number of interconnected chambers of various sizes and shapes in which sound waves are reflected to dampen or attenuate waves of a set frequency, typically resonance frequency. Each type of muffler has its disadvantages and the patent seeks to improve reaction mufflers of the side branch type through the utilization of a plurality of concentric sound passages through which exhaust gasses flow from an inlet to an outlet of the muffler along back-and-forth exhaust gas passages. The muffler also includes a central cylindrical passage between the muffler inlet and outlet and the latter is surrounded by the back-and-forth exhaust gas passages which are selectively provided with closed ends (sound reversal walls) for effecting sound dampening or attenuation at selected frequencies.

U.S. Pat. No. 6,089,347 granted on Jul. 18, 2000 to Ray T. Flugger discloses a muffler in which sound is reduced by incorporating a plurality of axially spaced cone-shaped partitions within a chamber of the muffler. Outward ends of the partitions defined between them spaces which are oriented with respect to the flow path of exhaust gasses so as to create a low pressure region within the spaces creating something of a venturi effect wherein exhaust gasses exteriorly of the partitions create low pressure regions between the partition walls. The orientation of the spaces between the partition walls with respect to the exhaust flow path exteriorly thereof is such that sound vibrations which enter the spaces and reflect off the partitions and the walls thereof as sound vibrations are attenuated between the partitions prior to exiting the muffler.

U.S. Pat. Nos. 5,530,214 and 6,105,716 issued respectively on Jun. 25, 1996 and Aug. 22, 2000, each in the name of Clyde A. Moorehead et al., disclose respectively a VENTURI MUFFLER and VENTURI MUFFLER HAVING PLURAL NOZZLES. In each case the venturi throat is sized to increase the speed of the gas flowing therethrough to decrease or attenuate noise.

U.S. Pat. No. 5,892,186 granted on Apr. 6, 1999 to Ray T. Flugger discloses a muffler for internal combustion engines which includes a central dispersion shell which tapers from an inlet to a minimum diameter at a restriction which is effective in attenuating noise by substantially reducing straight-through transmission of sound and by causing noise components to converge together thereby achieving sound frequency cancellation. A dispersion shell diverges from the restriction to an outlet and is surrounded by a perforated right-cylindrical shell which in turn is surrounded by a thermally insulating fiberglass layer and a ceramic fiber blanket.

U.S. Pat. Nos. 7,243,757 and 7,331,442 granted respectively on Jul. 17, 2007 and Feb. 19, 2008 to Karl Bernard Stuber and Alan Wall, respectively, are further examples of mufflers having inner passages provided with a variety of partitions, vanes, baffles or the like to reflect internal combustion exhaust gasses as they travel from inlet to outlet to reduce or attenuate exhaust noise.

BRIEF SUMMARY OF THE INVENTION

The invention is a venturi muffler preferably formed of a plurality of substantially identical metallic, conical, stepped venturi-forming segments which are maintained in coaxial relationship to each other between an inlet and an outlet of the muffler. In a preferred form of the invention, each stepped segment includes at least a large outermost annular wall having a plurality of openings or holes therein, an inner cylindrical wall, an innermost smaller annular wall having openings or holes therein, and a substantially conical outlet wall progressively decreasing in size in the direction of the muffler outlet. The venturi-forming segments are stacked to form a plurality of coaxial axially adjacent outer and inner annular chambers which can be arranged such that exhaust gasses entering an outermost annular chamber flow into the next downstream inner annular chamber and from the latter chamber flow through a venturi passage into a main central exhaust passage of the muffler before exiting the muffler outlet. Alternatively, the inner and outer annular chambers are not in fluid communication with each other, whereby exhaust gasses at the muffler inlet pass through the openings in the outermost annular walls without entering the inner annular chambers and exit directly through the muffler outlet while other exhaust gasses enter the holes of the innermost annular walls into the inner annular chambers and pass therethrough and through the venturi passages into the main exhaust passage to the muffler outlet. In each case the plurality of venturi passages create a partial vacuum in the inner or both the inner and outer annular chambers and from one annular chamber to the other thereby creating a substantially continuous partial vacuum through the length of the combined segments through which sound waves cannot propagate from inlet to outlet thereby reducing the exhaust sound pressure waves and attenuating/reducing muffler exhaust noise. As exhaust gasses enter the outermost annular chambers through the openings in the outermost annular walls, they are reflected back (and forth) in each chamber to cancel out or attenuate incoming sound waves 180 degrees out of the phase with each other to reduce sound and absorb heat. In this way, each outermost annular chamber will have a different reflective frequency from the inlet to the outlet of the muffler to cancel out, lessen or attenuate the incoming pressure waves as the internal combustion engine revs at different RPM's.

Whether the inner and outer annular chambers are in fluid communication with each other or not, in each case the innermost series of holes in the innermost annular walls supply exhaust to the succeeding conical shaped venturi passages. As the exhaust pressure increases, so too does the vacuum/partial vacuum in one or both sets of inner and outer annular chambers. As the exhaust pressure travels through the muffler from the inlet to the outlet, succeeding inner and/or outer annular vacuum chambers are progressively starved because the first set of innermost holes of the first venturi-forming segment limits the exhaust supply and there is a decreasing exhaust pressure supplied to the succeeding downstream innermost annular chambers. The partial vacuum is created in all venturi passages or channels because of the higher pressure of the exhaust gasses flowing relatively unimpeded along a center exhaust gas passage/flow path from the muffler inlet to the muffler outlet, except, of course, for the restriction caused by the conical exhaust outlet wall of each segment.

The venturi muffler of the invention further acts as a heat sink to remove heat from the engine exhaust as it passes therethrough and converts the heat into thermo-electrical power. Each of the venturi-forming segments and specifically each of the outermost cylindrical walls thereof form the exterior of the muffler or are in intimate surface-to-surface contact with an exterior outermost metallic sleeve. Thermo-electric modules are connected to the outermost annular walls of the segments or to the outermost metallic sleeve and the heat of the exhaust gasses which is extracted by each of the segments is conducted therethrough to the outermost annular walls of each segment and/or to the cylindrical outermost sleeve, wall or casing surrounding the same to which are connected thermal-electric modules for converting the exterior normally wasted heat to electrical power. Additionally, when heat is removed from the exhaust, energy is removed and the sound/noise of the exhaust is further lowered. The partial vacuum created by the exhaust gasses passing between inner and outer surfaces of the conical outlet walls of each venturi-forming segments also draws the hot exhaust gasses across the surfaces of both sides of each conical wall outlet to maximize heat extraction from the exhaust gasses and conduct the same to the exterior of the muffler.

In further accordance with the invention, the annular series of holes in the outermost and innermost annular walls of the segments also break up the sound waves into smaller Eddie currents which reduce sound as sound waves are introduced into each annular chamber causing reflection thereof progressively from the muffler inlet to the muffler outlet which dissipates sound energy without robbing engine power and saving fuel by lowering engine back pressure while at the same time converting normally wasted heat into thermo-electric power. Each venturi muffler can be "tuned" by varying the number of venturi-forming segments to efficiently dampen or attenuate the specific frequencies which are desired to be cancelled out of incoming sound waves. The venturi muffler can be further "tuned" by varying the size and number of the holes in the innermost and/or outermost annular walls, the axial length of the peripheral walls which varies the axial length of the innermost and/or outermost chambers and the length, angle of convergence and discharge opening of each of the conical venturi-forming walls.

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENTS

Figure 1:
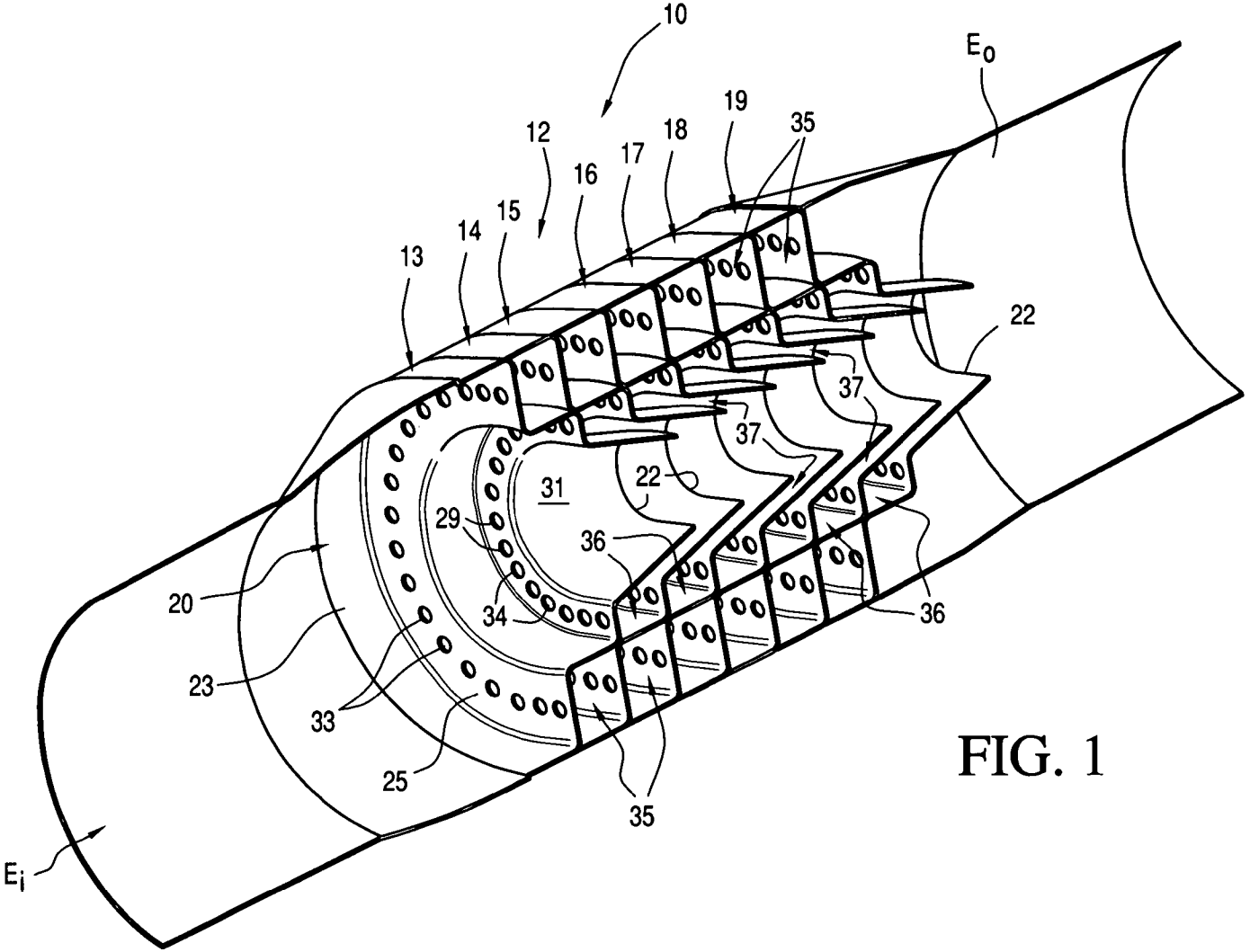
FIG. 1 is an axial cross-sectional perspective view, and illustrates a venturi muffler of the invention having an inlet and an outlet and therebetween a plurality of substantially identical metallic venturi-forming segments assembled in axially stacked relationship in a manner to create a partial vacuum in one or both of a plurality of axially innermost and axially outermost annular sound-reflecting chambers thereby reducing/attenuating/eliminating and/or damping exhaust noise.

A venturi muffler constructed in accordance with this invention is fully illustrated in FIG. 1 of the drawings and is generally designated by the reference numeral 10. The venturi muffler 10 includes an exhaust inlet Ei, an exhaust outlet Eo, and therebetween a medial sound damping or sound attenuating section 12 which dampens, reduces, attenuates or muffles the noise caused by the sudden expansion of internal combustion chamber exhaust gasses of a conventional internal combustion engine (not shown) connected to the exhaust inlet Ei.

Figure 2:
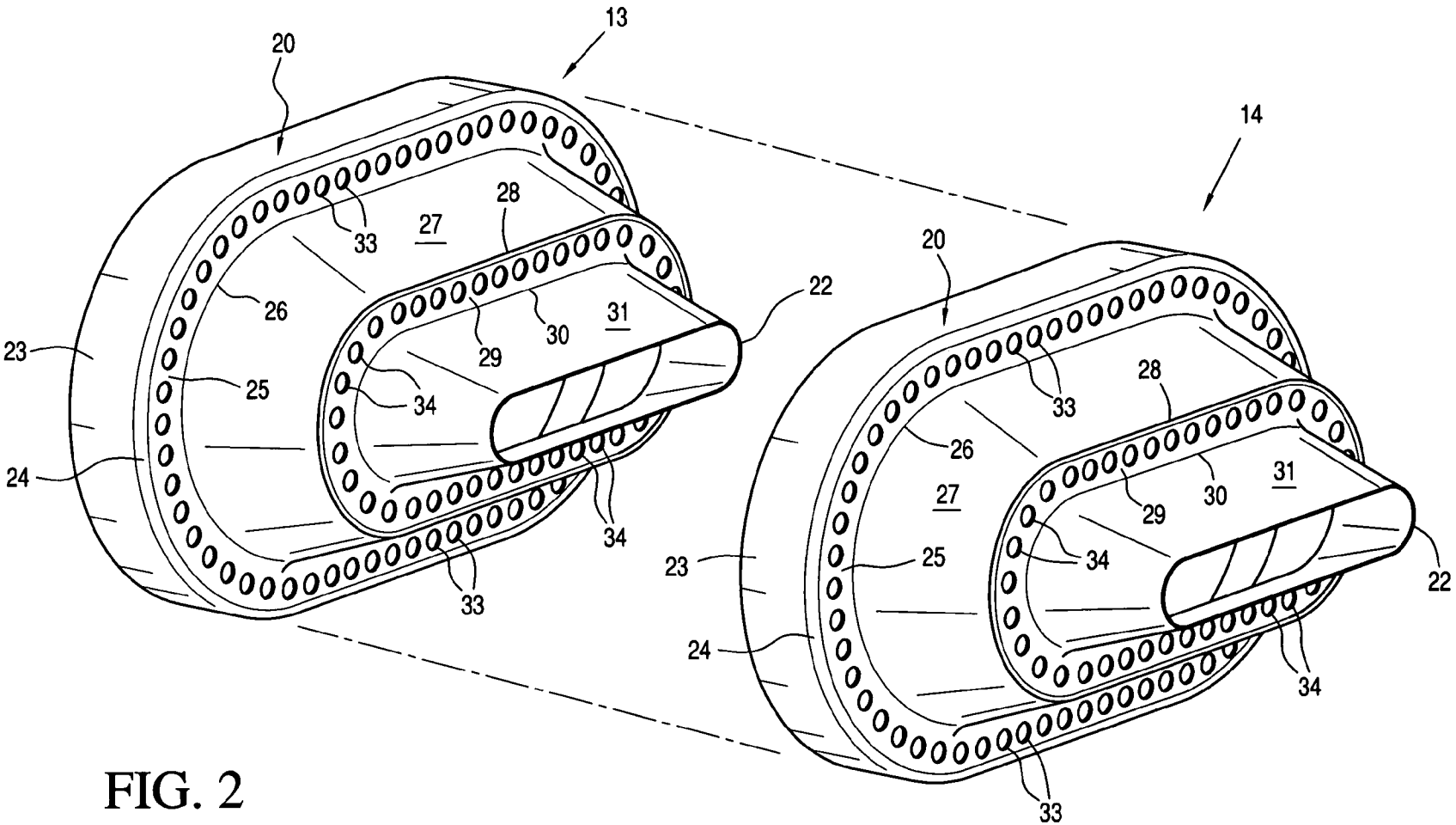
FIG. 2 is an exploded perspective view of two identical metallic, conical, stepped, venturi-forming segments, and illustrates outermost and innermost annular walls each having openings therein and a substantially conical venturi-forming outlet wall.

The sound damping section 12 is, for illustrative purposes, formed by seven vacuum or partial vacuum-forming/venturi-forming segments 13 through 19, though more or less such venturi-forming segments may be utilized depending upon the particular application. The venturi-forming segments 13 and 14 of FIGS. 1 through 3 will be described in detail and the description thereof is equally applicable to the remaining venturi-forming segments 15 through 19.

Each of the venturi-forming segments 13, 14 is defined by a metallic highly heat conductive, tubular stepped member 20. Each tubular stepped member 20 is defined from an exhaust entrance opening 21 (FIG. 3) to an exhaust exit opening 22 by an outermost peripheral wall 23, a peripheral radius or shoulder 24, an outermost annular wall 25, a peripheral shoulder or radius 26, an annular wall 27, a peripheral radius or shoulder 28, an innermost annular wall 29, a peripheral shoulder or radius 30 and an innermost venturi-forming or venturi passage forming wall 31 converging in a direction from the peripheral shoulder or radius 30 to the exhaust exit opening 22 of each tubular stepped member 20. The outermost annular wall 25 includes a plurality of circular openings or holes 33 in equally spaced relationship to each other. The innermost annular wall 29 likewise includes a plurality of substantially equally spaced openings or holes 34.

Figure 3:
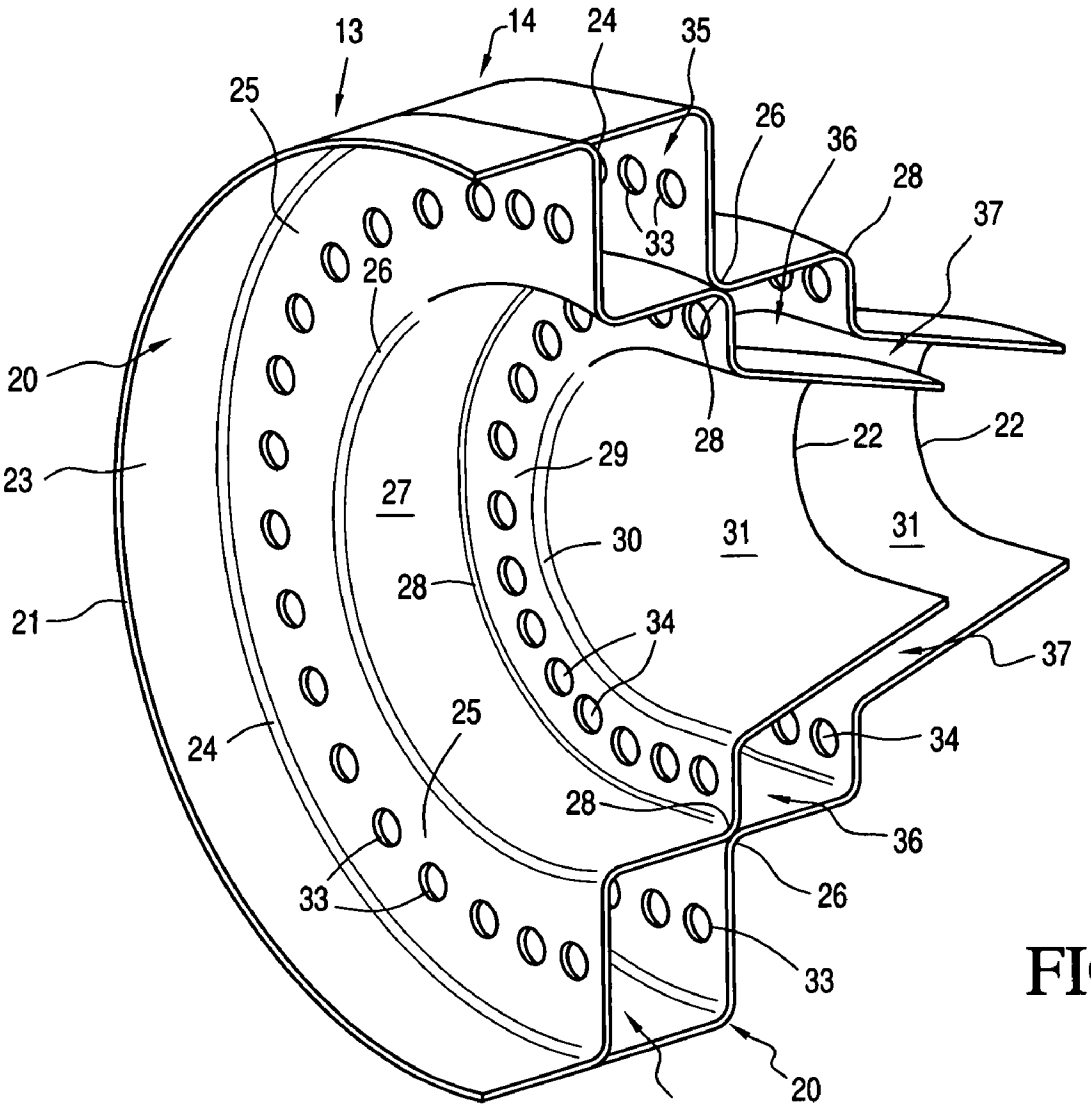
FIG. 3 is a fragmentary perspective view of the two venturi-forming or vacuum-forming segments of FIG. 2, and illustrates the two venturi-forming segments assembled in stacked relationship to each other and collectively defining an outermost annular chamber, an innermost annular chamber and a venturi passage between the conical venturi-forming outlet walls which create a partial vacuum in the innermost annular chamber for reducing, attenuating or dampening the noise of combustion engine exhaust flowing through the muffler.

The sound damping section 12 (FIG. 1) is formed by internesting or stacking adjacent pairs of the tubular stepped members 20 of the venturi-forming segments 13 through 19 in substantially internested coaxially aligned relationship, as is evident in FIG. 1 of the drawings, which establishes between any two adjacent tubular stepped members 20 of the venturi-forming segments 13 through 19 an outermost annular sound-reflective/reflecting chamber 35, an innermost annular sound-reflective/reflecting chamber 36 and an annular venturi passage 37 defined between the conical venturi-forming converging outlet walls 31 of adjacent sound damping sections 13, 14; 14, 15; 15, 16; 16, 17; 17, 18 and 18, 19 (FIG. 1). The holes or openings 33 in the outermost annular walls 25 of all of the sound damping tubular stepped members 20 are in axial alignment, as are the holes or openings 34 ion the inner annular walls 29 of the tubular stepped members 20. As is best illustrated in FIG. 3, the shoulder or radius 28 of each upstream tubular stepped member 20, as viewed in the direction of exhaust flow from the exhaust entrance opening 21 to the exhaust exit opening 22, contacts the shoulder or radius 26 of the next adjacent downstream tubular stepped member 20. The contact between the radiuses or shoulders 28, 26, as is best illustrated in FIG. 3, essentially closes off fluid communication between the annular sound-reflective chambers 35, 36. When the venturi muffler 10 is assembled in the manner illustrated in FIG. 1 of the drawings, the tubular stepped members 20 of the venturi-forming segments 13 through 19 are welded or rolled sealed to each other and to the exhaust inlet entrance opening or inlet Ei and the exhaust outlet Eo.

Figure 4:
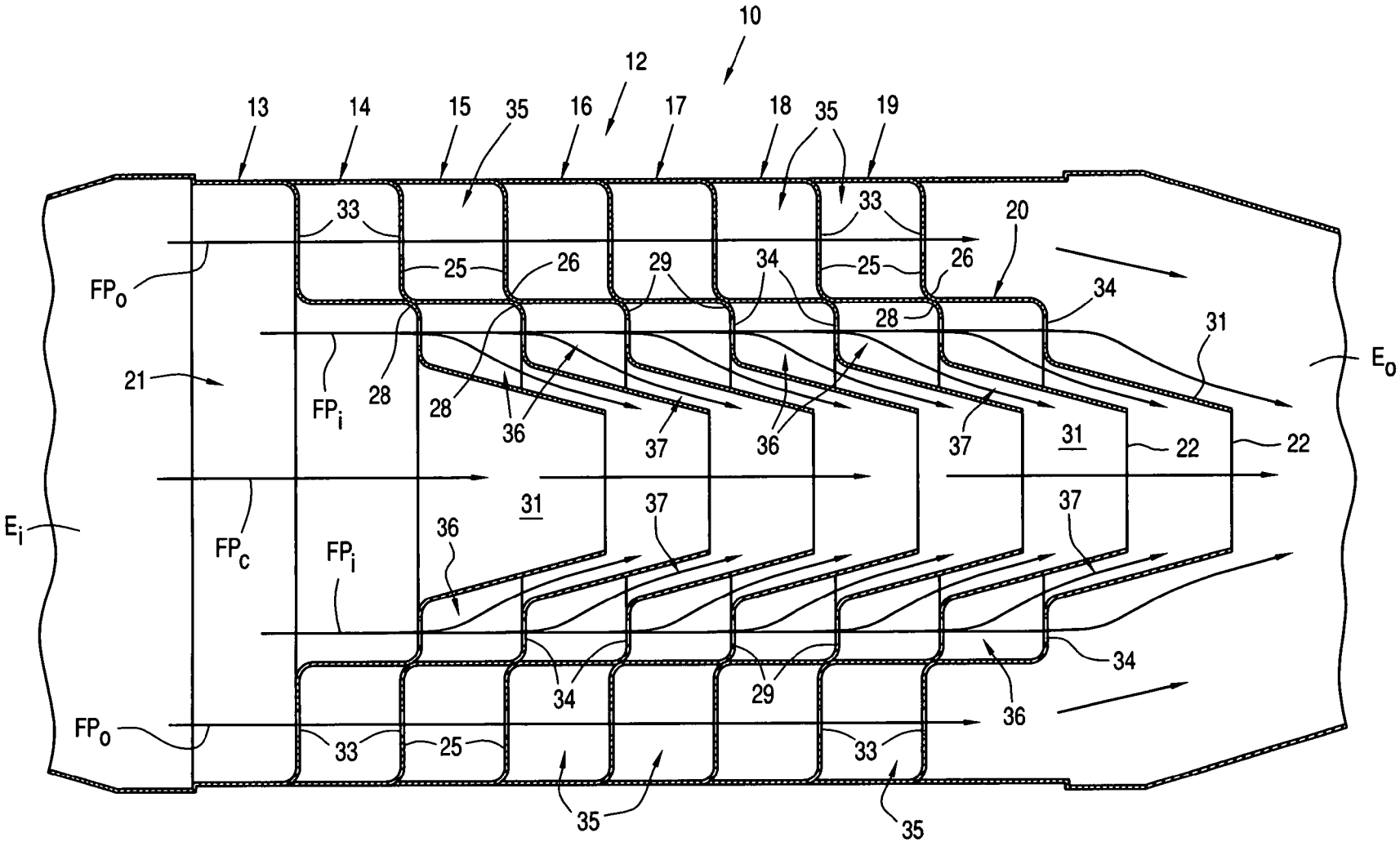
FIG. 4 is a fragmentary axial cross-sectional view through the venturi muffler of FIG. 1, and diagrammatically illustrates the exhaust flow through the muffler from the inlet to the outlet creating a partial vacuum in the innermost annular chambers effecting sound dampening as exhaust is drawn through the venturi passages by the exhaust flow passing through the center of the muffler.
Figure 5:
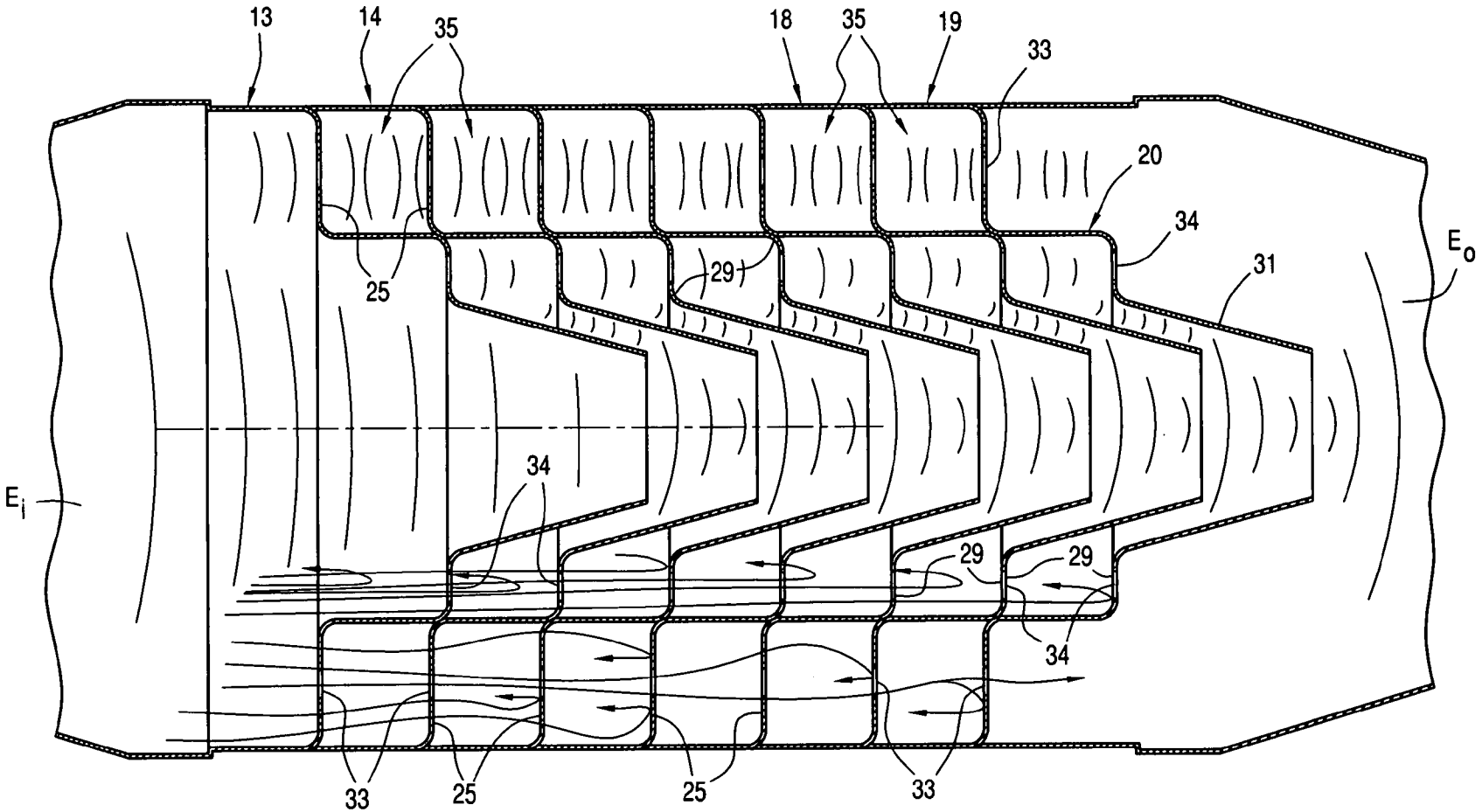
FIG. 5 is a fragmentary axial cross-sectional view of the venturi muffler of FIGS. 1 through 4, and illustrates the manner in which sound waves are reflected as they pass from the muffler inlet to the muffler outlet through the outer annular sound reflective chambers, the inner annular sound reflective chambers and the venturi passages with commensurate sound dampening created by the partial vacuum created in the innermost annular sound reflective chambers.

As exhaust or exhaust gasses from an internal combustion engine (not shown) enter the exhaust inlet Ei and the exhaust entrance opening 21 of the venturi-forming segment 13, several distinct exhaust flow paths are established, namely, a plurality of outermost exhaust flow paths FPo (FIG. 4) passing through all of the aligned holes or openings 33, into and out of the outermost sound-reflective annular chambers 35 and exiting into the exhaust outlet Eo. A similar intermediate exhaust flow path FPi flows through all of the axially aligned holes or openings 34 of the annular walls 29, into and through the innermost annular reflective chambers 36 and both exit the last series of holes or openings 34 in the venturi-forming segment 19 or flow through each venturi passage 37 under the influence of an axial or central exhaust flow path FPc from the exhaust inlet Ei to the exhaust outlet Eo which creates a vacuum or partial vacuum in each of the innermost annular reflective chambers 36 through which sound cannot propagate thereby reducing, damping or attenuating the exhaust sound pressure waves in the manner diagrammatically illustrated in FIG. 5 of the drawings. Referring specifically to FIG. 5, the lower unnumbered headed arrows indicate the manner in which sound waves pass through the openings 33 and 34 and are reflected back (and forth) by the annular walls 25 and 29. As each sound wave is reflected in a direction back toward the exhaust inlet Ei, it meets and cancels out an on-coming sound wave 180 degrees out of phase to both reduce sound and absorb heat, as is depicted in the upper illustrated portions of the annular sound wave reflecting or reflective chambers 35 and 36, the amplitude or height of which is illustrated as decreasing from the sound-reflective chamber 35 defined between the venturi-forming segments 13 and 14 and the last sound-reflective chamber 35 defined between the venturi-forming segments 18 and 19. Additionally and most importantly, the flow of exhaust along the central exhaust flow path or flow passage FPc (FIG. 4) creates an increasing partial vacuum in each of the innermost annular chambers 36 toward the exhaust outlet Eo as exhaust gasses are drawn through the venturi passage 37 by and into the central exhaust flow path FPc. Therefore, all annular sound-reflective chambers 35, 36 reduce sound by reflecting sound waves between the respective annular walls 25 and 29 thereof, and additional sound dampening occurs in the innermost sound reflective chambers 36 by the partial vacuum formed therein. Therefore, the exhaust sound or noise is reduced, attenuated or dampened by (1) the cancellation of sound waves 180 degrees out of phase with each other when moving axially through all of the annular chambers 35, 36 by reflection between the respective annular walls 25 and 29, (2) the creation in the annular chambers 36 of a partial vacuum through which sound cannot propagate or propagates minimally, and (3) by the heat removed by all of the venturi-forming segments 13 through 19. An increase in the cancellation of sound waves in the annular sound-reflective chambers 35 and 36 can be effected by eliminating the holes or openings 33, 34 in the respective annular walls 25, 29 of the last tubular stepped member 20 of the last venturi-forming segment 19. Additionally, the holes or openings 34 in the annular wall 29 of the tubular stepped member 20 of the first venturi-forming segment 13 are sized to limit the exhaust flow along the exhaust flow path FPi (FIG. 4) so that the substantially higher rate of flow of the exhaust along the central exhaust flow path FPc draws the gasses from the innermost annular chambers 36 via the venturi passages 37 thereby assuring the creation of sound dampening partial vacuums in each of the annular chambers 36 which progressively increase from chamber to chamber in the direction of exhaust flow until exiting into the exhaust outlet Eo. The last venturi-forming wall 31 adjacent the exhaust outlet 12 also functions as a check valve which prevents atmospheric pressure from entering the venturi muffler 10 which saves back pressure efficiencies of the associated internal combustion engine (not shown). Thus, the venturi muffler 10 saves fuel by lowering engine back pressure in addition to cancelling out or damping incoming combustion engine noise/sound waves over a wide frequency range.

Reference is made to FIGS. 6 through 9 of the drawings in which a venturi muffler 10' (FIGS. 7 through 9) is illustrated and all components thereof corresponding to the components of the venturi muffler 10 have been identically numbered and primed.

The muffler 10' includes a sound damping section 12' between an exhaust inlet Ei and an exhaust outlet Eo. The sound damping section 12' is defined by venturi-forming segments 13' through 18', each being in the form of a metallic tubular stepped member 20' (FIG. 6), and when internested in the manner illustrated in FIGS. 6 through 9, the radiuses or shoulders 26', 28' are slightly spaced from each other, as opposed to the sealing contact between the shoulders or radius portions 26, 28 of the tubular stepped embers 20 of the venturi muffler 10. Accordingly, an annular gap 39 (FIGS. 7 through 9) between each of the radiuses or shoulders 26', 28' places all adjacent annular reflective chambers 35', 36' in fluid communication and the venturi effect created via the venturi passages 37 earlier described with respect to the exhaust flow paths of FIG. 4 create a partial vacuum in both the outermost annular chambers 35' and the innermost annular chambers 36' (FIG. 7) thereby increasing the sound dampening of the exhaust gasses.

Figure 9:
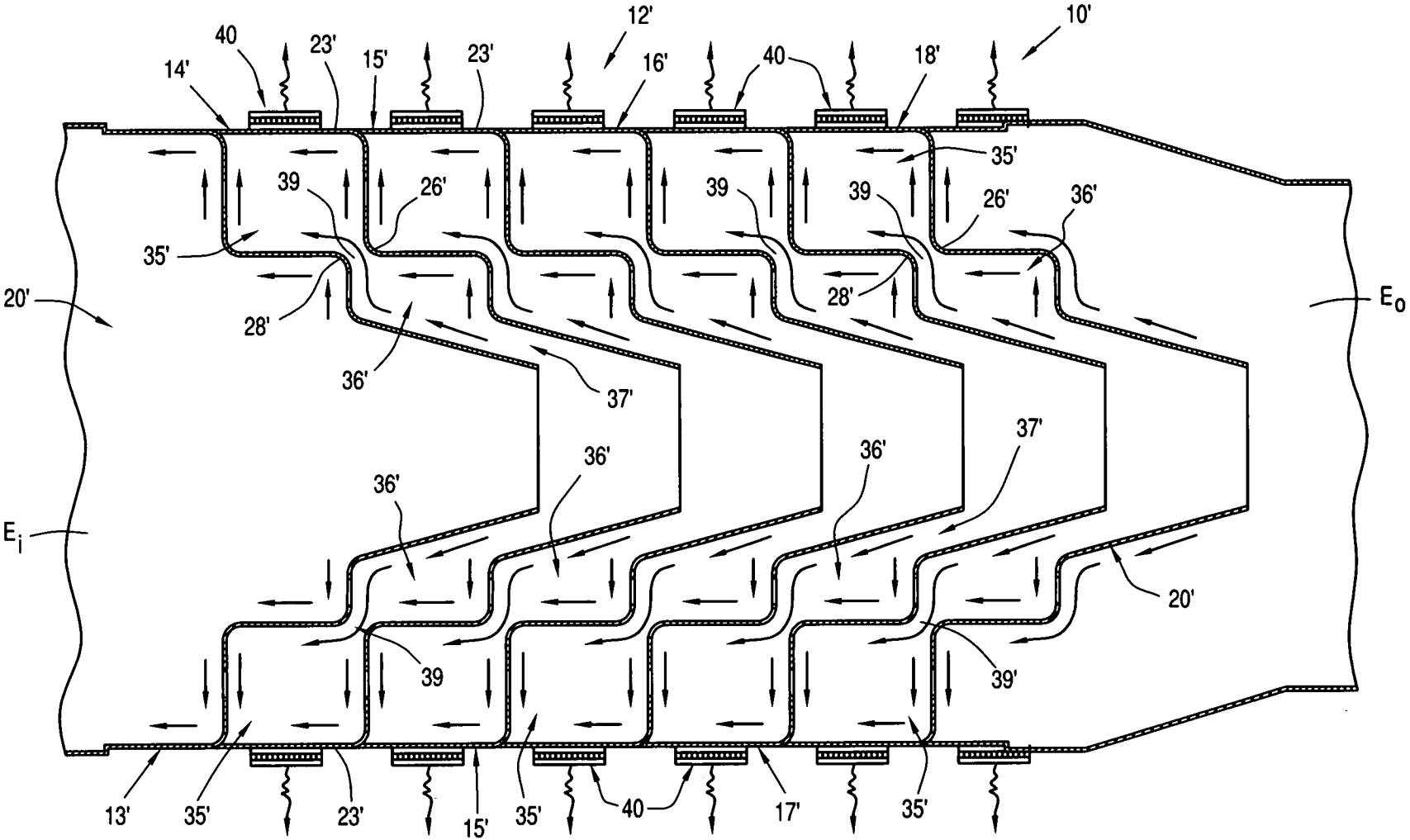
FIG. 9 is a diagrammatic axial view of the venturi muffler of FIG. 7, and illustrates the manner in which heat from the exhaust gasses is extracted by the metallic venturi-forming segments and is conducted to outermost annular walls thereof which carry thermo-electric modules for transforming exhaust heat into electric power.

The venturi muffler 10' of FIG. 9 also includes against the outer surface (unnumbered) of the outermost annular walls 23' of each metallic tubular stepped member 20' thermo-electric modules 40 substantially surrounding the entirety of the sound damping section 12' which absorb the heat of the exhaust gasses conducted or convected thereto, as indicated by the unnumbered headed arrows in FIG. 9, to convert exhaust gas heat into thermo-electrical power.

Figure 10:
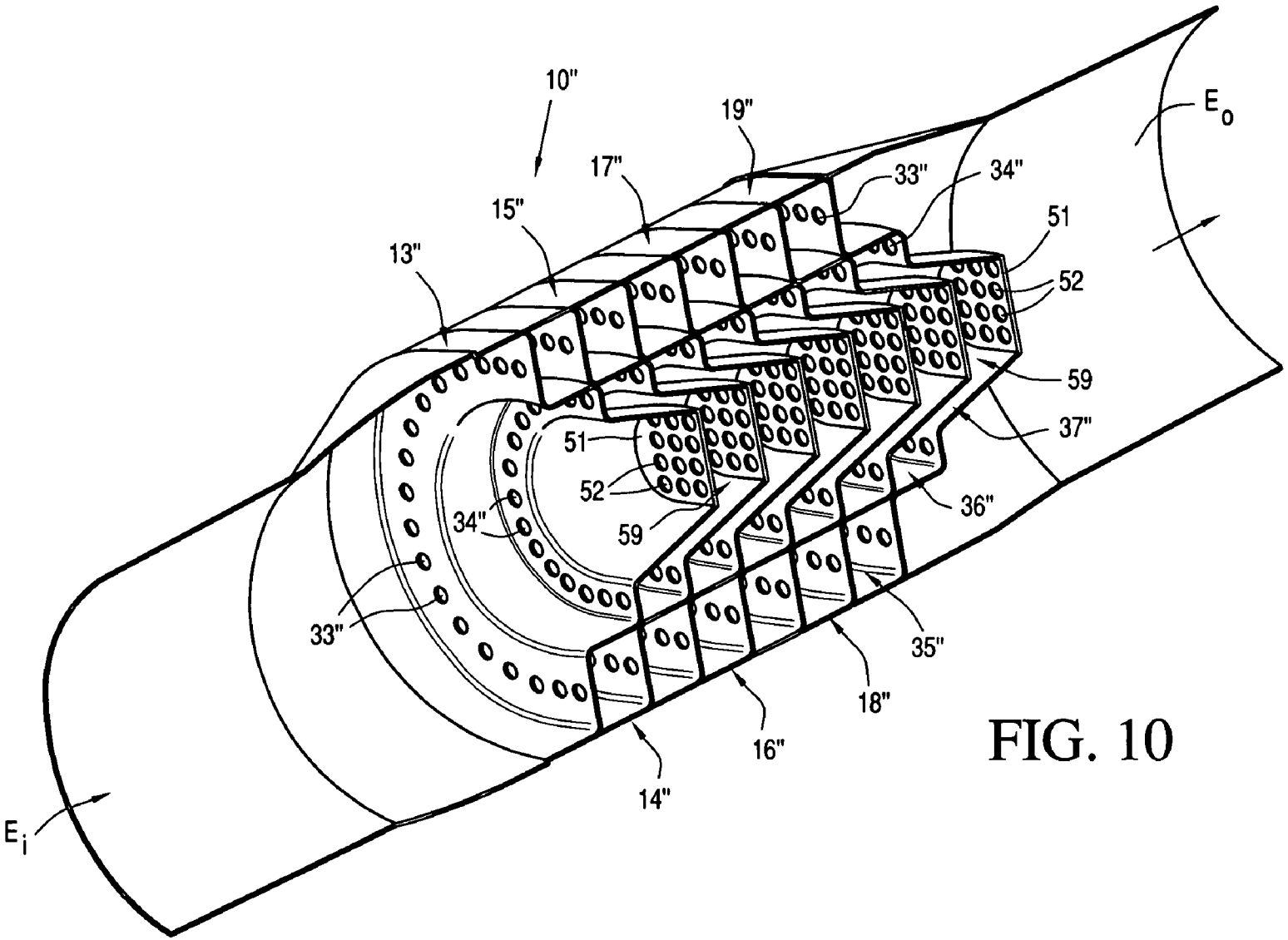
FIG. 10 is another venturi muffler of the invention, and illustrates a plurality of metallic, conical, stepped venturi-forming segments, each including at the end of an innermost conical venturi-forming wall an end wall having a plurality of openings therein.
Figure 11:
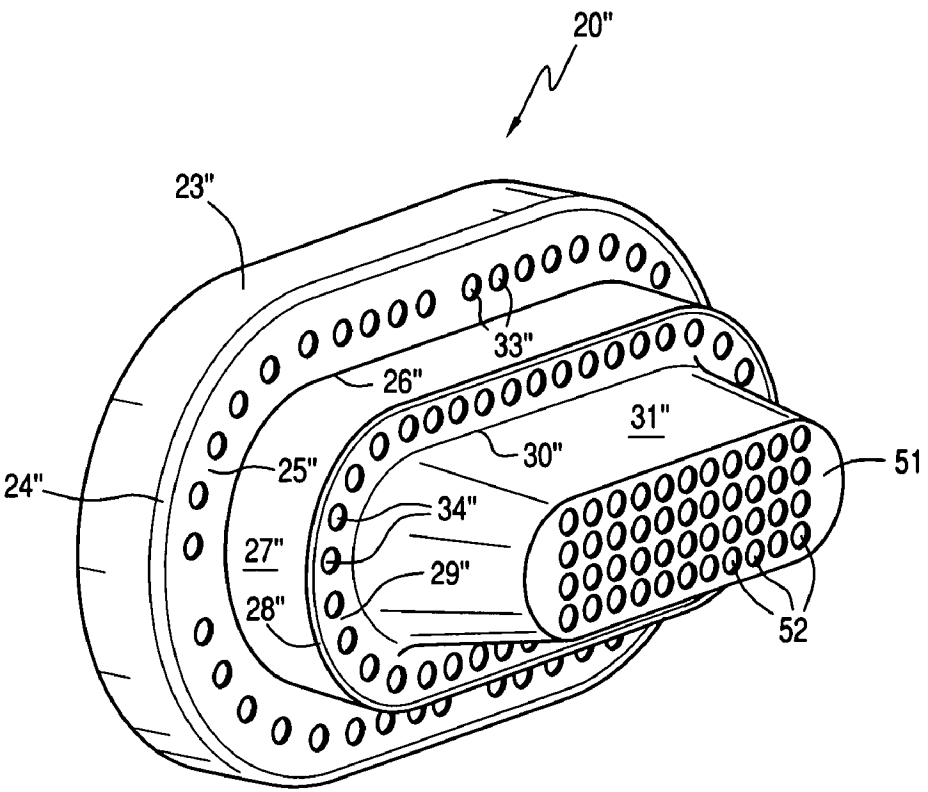
FIG. 11 is a perspective view of one of the venturi-forming segments of the venturi muffler of FIG. 10, and illustrates details thereof.

Another venturi muffler 10" (FIG. 10) is substantially identical to the venturi muffler 10 and like components have been identified by identical reference numerals which have been double primed. The difference in the venturi muffler 10" is that each metallic tubular stepped conical member 20" (FIG. 11) does not include a single exhaust exit opening, such as the opening 22 (FIG. 2) at the venturi-forming outlet wall 31 of each tubular stepped conical member 20. Instead, the venturi-forming outlet walls 31 of the venturi muffler 10 are closed in the venturi muffler 10" by a wall 51 (FIG. 11) having a plurality of holes or openings 52 with the holes or openings 52 being in axial alignment (FIG. 10). In operation, the muffler 10" functions as heretofore described with respect to the venturi muffler 10, but in addition thereto all adjacent pairs of end walls 51 define sound reflective chambers 59 which reflect the sound waves to achieve further cancellation/damping of exhaust gas noise in the manner described with respect to FIGS. 4 and 5 of the drawings.

Figure 6:
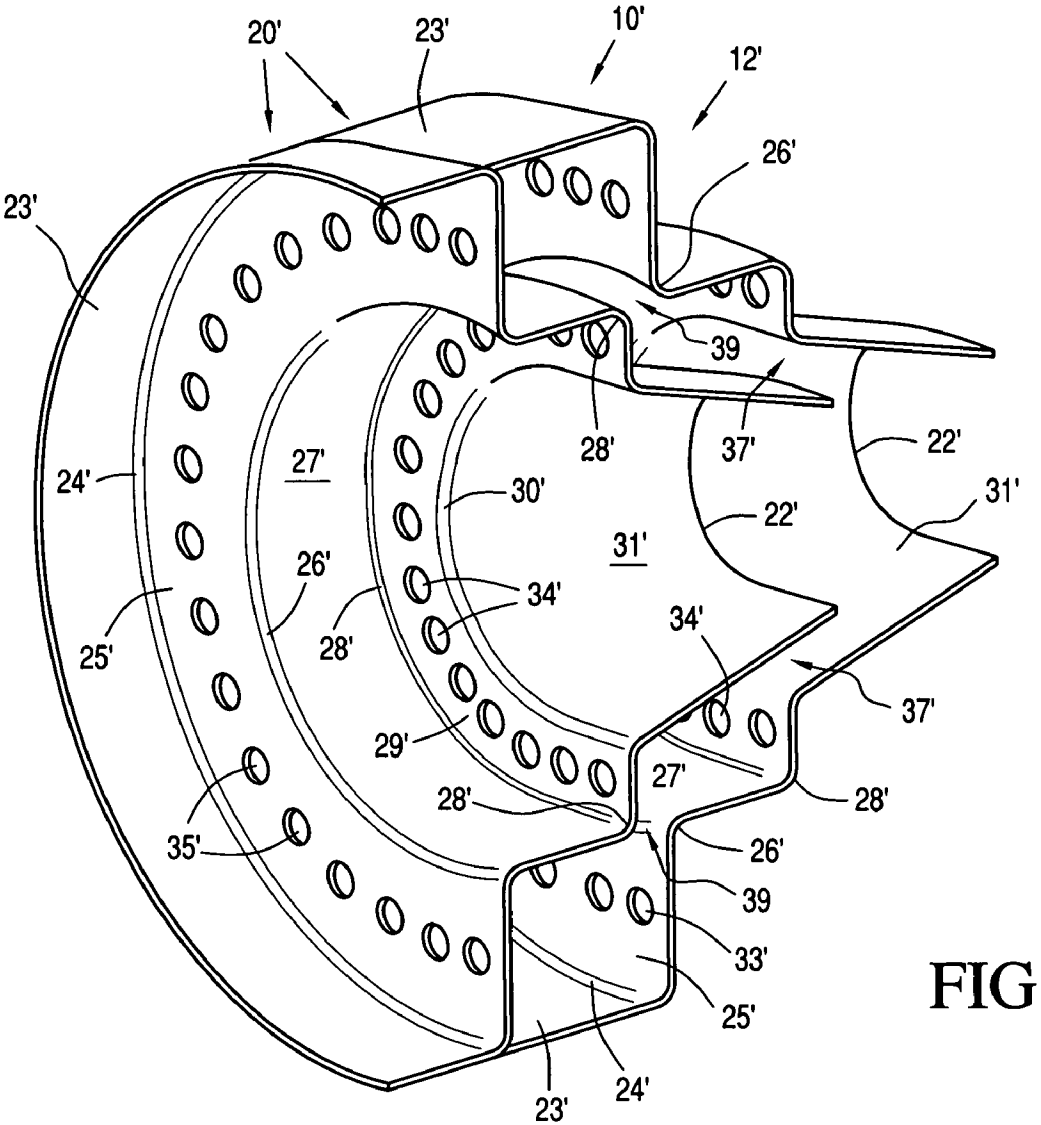
FIG. 6 is a fragmentary perspective view of two metallic, conical stepped, venturi-forming segments similar to the venturi-forming segments of FIG. 3, and illustrates an outermost annular chamber in fluid communication with an innermost annular chamber and the latter opening into a venturi passage which in turn opens into a central axial exhaust passage of the muffler.
Figure 7:
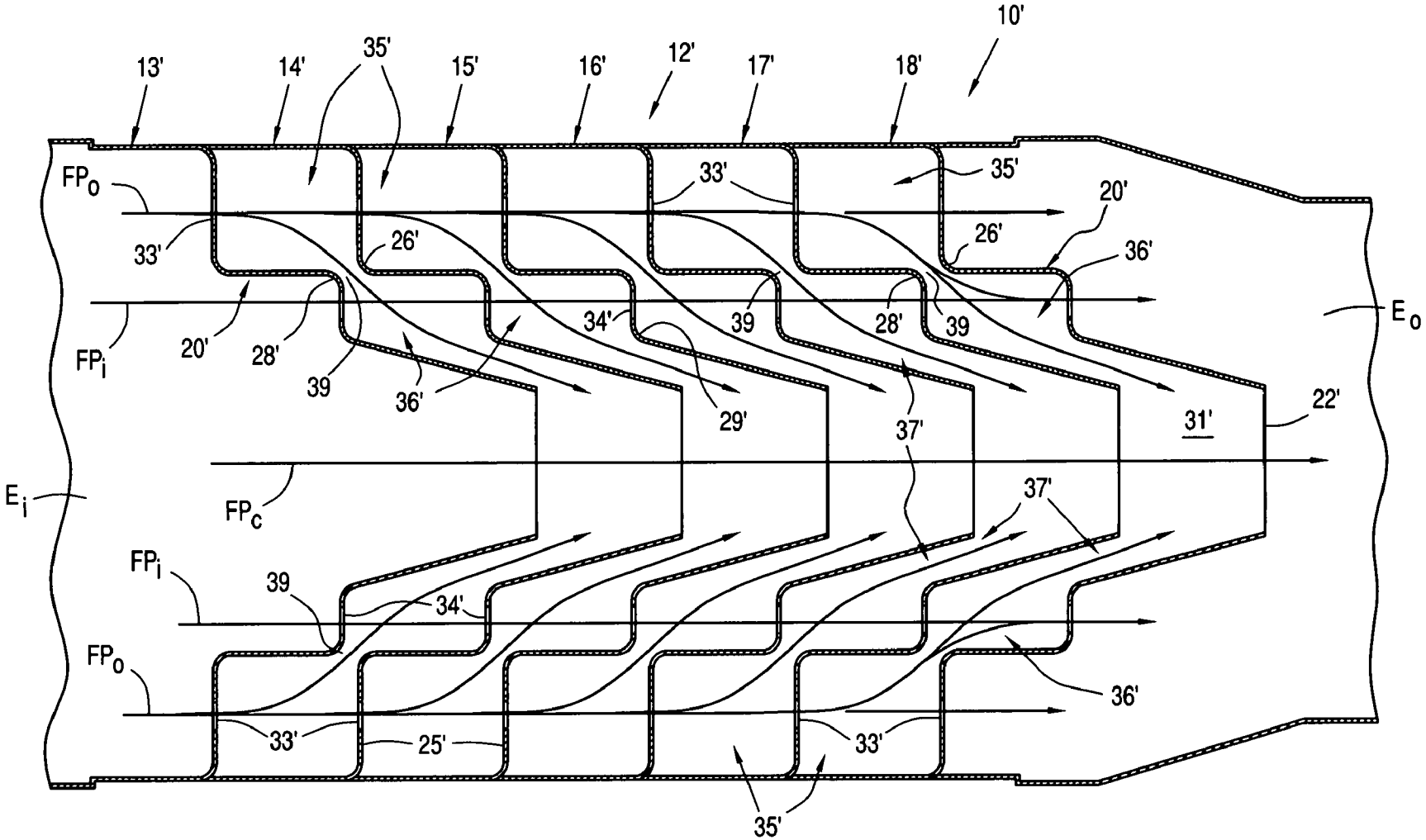
FIG. 7 is a fragmentary axial cross-sectional view of a venturi muffler formed by stacking the venturi-forming segments of FIG. 6, and illustrates by headed arrows the exhaust flow therethrough including flow from each outermost annular chamber into an associated innermost annular chamber and through the associated venturi passages into the central exhaust passage of the muffler.
Figure 8:
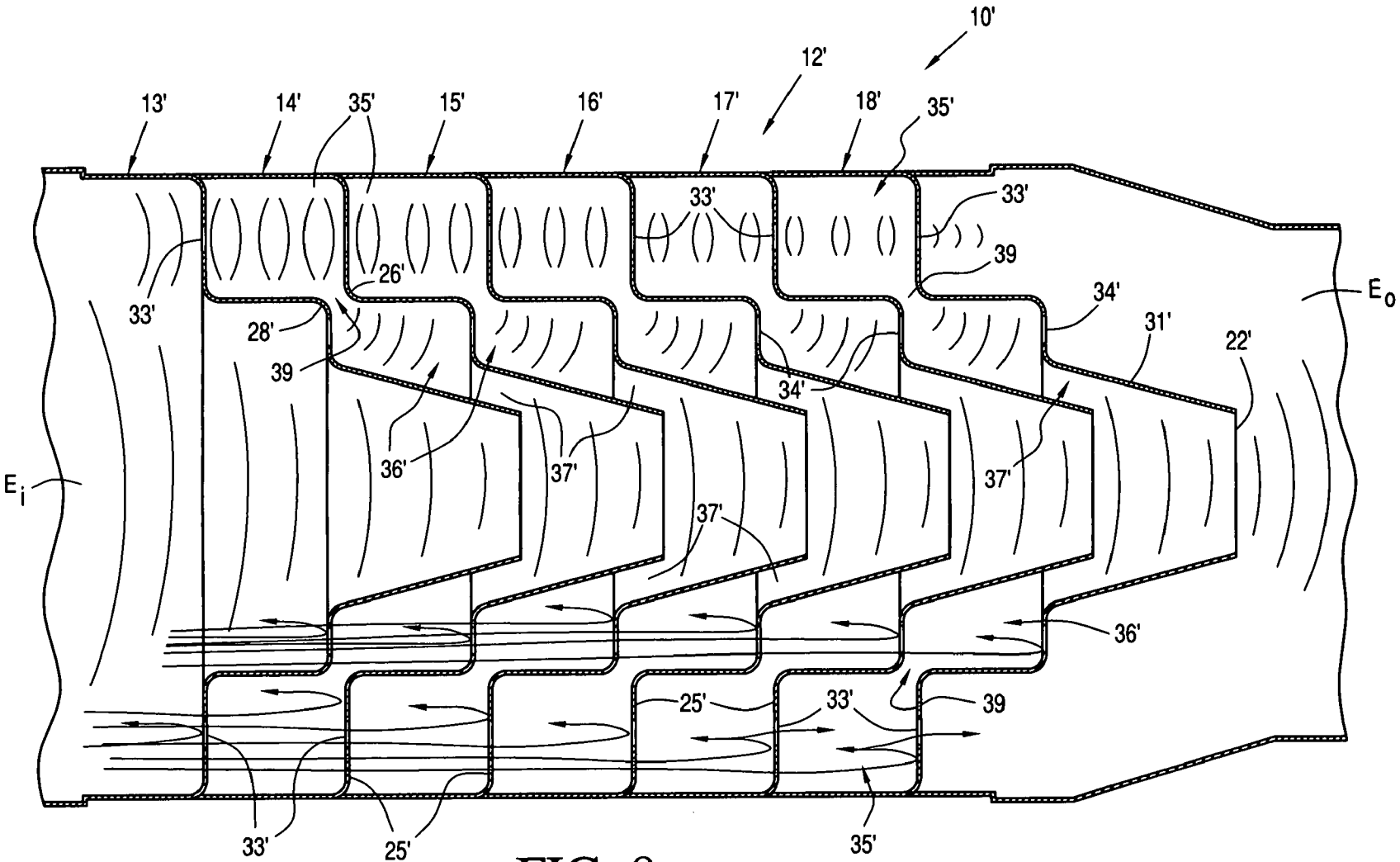
FIG. 8 is a fragmentary axial cross-sectional view of the venturi muffler of FIG. 7, and illustrates sound waves and the dampening thereof as exhaust flows from the muffler inlet to the muffler outlet.
Figure 12:
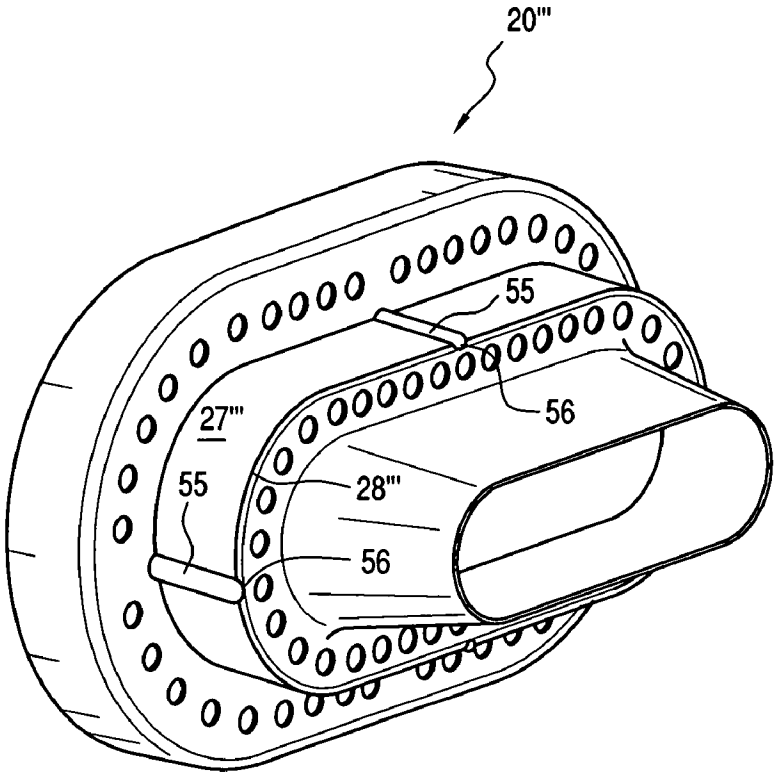
FIG. 12 is another metallic, conical, stepped venturi-forming segment, and illustrates an innermost annular wall having four peripherally spaced axial ribs which project slightly beyond the innermost annular wall to maintain all innermost and outermost annular chambers in slightly spaced stacked relationship to each other.

In FIG. 3 of the drawings, the shoulders of radiuses 26, 28 are illustrated in contacting/sealing relationship though obviously within tolerance some minor leakage might occur therebetween resulting in slight exhaust flow from the outermost annular sound-reflective chambers 35 into the innermost sound-reflective chambers 36. In FIG. 6, the radiuses or shoulders 26, 28 are appreciably spaced from each other to define the annular flow passages 39 (FIGS. 6 and 8). Obviously, the pressure of internal combustion engine exhaust gasses can create variations in sizes of the passages 39 or create varying degrees of "leakage" between the shoulders 26, 28. In order to maintain a specific minimum sized passage 39, a metallic tubular conical stepped member 20'" shown in FIG. 12 includes four equally spaced ribs 55, each projecting radially outwardly from the innermost annular wall 27'" and projecting axially slightly beyond the shoulder or radius 28'" in the form of a nose 56. When such stepped members 20'" are stacked in the manner heretofore described with respect to the venturi muffler 10 of FIG. 1, the ribs 55 and noses 56 maintain desired and exact minimum spacing in the area of the passage 39 (FIG. 8) particularly under varying exhaust pressures as the speed of an associated internal combustion engine is varied.

Another venturi muffler 110 (FIGS. 13 and 14) is similar to the venturi muffler 10 and like components have been identified by identical reference numerals preceded by 100. The major difference between the venturi muffler 10 and the venturi muffler 110 is that the conical venturi-forming outlet wall 131 of each tubular annular step member 120 has welded thereto an exterior spiral vane or fin 60, the circumferential and axial length of which can vary but in all cases the function thereof is to create a spiral vortex Sv of the exhaust gasses as they flow through the venturi passages 137 from the inner sound-reflective annular chambers 136. As is most readily apparent from a comparison of FIGS. 4 and 13, the spiral vortex exhaust gasses Sv travel a greater distance between the annular reflective chambers 136 and the exhaust exit opening 122 of each venturi-forming wall 131 as compared to the same distance of exhaust gas flow through the venturi passages 37 of the venturi muffler 10. The greater distance of travel of the exhaust gasses along the spiral vortex Sv further lessens or attenuates sounds and additional heat can be extracted therefrom by the spiral vanes 60 which further increases the power that can be derived therefrom when the venturi muffler 110 utilizes thermo-couples 40, as in the case of the venturi muffler 10' (FIG. 9). Two other differences in the venturi muffler 110, as compared to the venturi muffler 10, is that the venturi muffler 110 only includes the inner sound-reflective annular chambers 136 (excluding the outer annular sound-reflective chambers 35 of the venturi muffler 10, and the holes or openings 133 are elongated and arcuate to augment the formation of the spiral vortex exhaust gasses Sv as they are drawn through the venturi passages 137.

Figure 14:
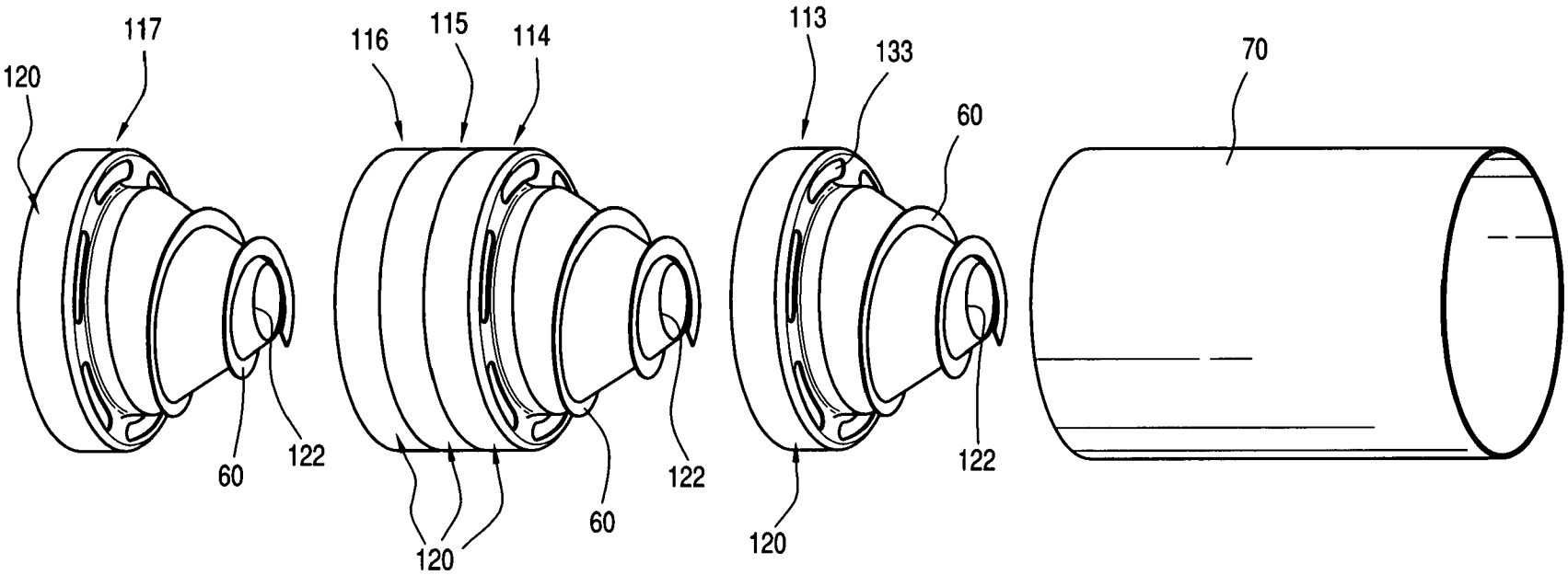
FIG. 14 is is a side perspective exploded view of the three assembled venturi-forming segments of FIG. 13, along with two additional venturi-forming segments, and illustrates the manner in which the same are progressively stacked individually or as groups of segments into an outermost metallic cylindrical sleeve defining a force-fit with an outermost peripheral wall of each venturi-forming segment to maintain the venturi muffler formed therefrom in assembled relationship.

The venturi muffler 110 is also manufactured in the manner heretofore described with respect to the venturi muffler 10 by stacking or axially assembling tubular metallic stepped members 120 in the manner best illustrated in FIG. 14 of the drawings. However, rather than welding the tubular stepped members 120 to each other, a metallic tubular sleeve 70 is expanded at a temperature well beyond the temperature of exhaust gasses which flow through the venturi muffler 110. When the metallic cylindrical sleeve 70 is so expanded, venturi segments 113 through 117, etc., are inserted under a forced fit into the expanded sleeve 70 which when cooled, maintains all of the tubular stepped members 120 in assembled relationship.

Figure 15:
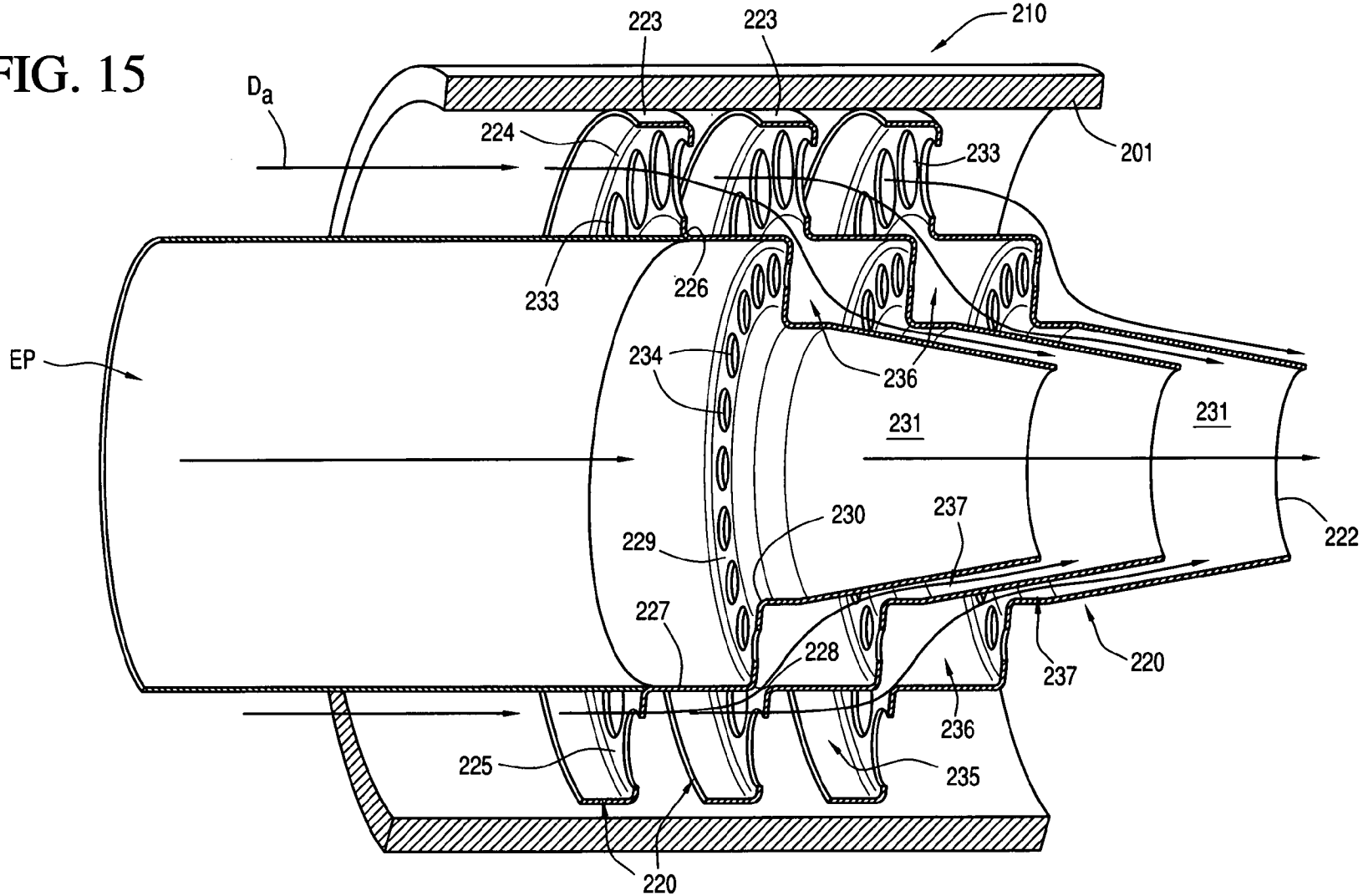
FIG. 15 is an axial cross-sectional view of another venturi muffler and three venturi-forming segments thereof similar to the segments of FIG. 1, and illustrates the manner in which the same can be connected to a jet engine exhaust pipe to not only attenuate exhaust noise but also reduce its "heat signature" through heat dissipation by outside air passing through relatively large peripheral openings of an outermost annular wall of each segment and an exterior sleeve or acoustic material.

Reference is made to FIG. 15 of the drawings in which a venturi muffler 210 is illustrated and all components thereof corresponding to the components of the venturi muffler 10 have been identically numbered and preceded by "200." The venturi muffler 210 is illustrated conventionally connected to an exhaust pipe EP of an aircraft jet engine (not shown) by which sound damping or attenuation is achieved in a manner heretofore described with respect to the venturi muffler 10. However, a major function achieved by the venturi muffler 210 is the reduction of the "heat signature" of the jet engine through (1) conduction of heat through the metallic tubular step members 220 radially outwardly and into a heat-absorbing sleeve 201 of acoustic material (fiberglass, porous ceramic, etc.) and (2) forming the openings 233 larger than the openings 33 of the of the venturi muffler 10 such that outside air Oa passing therethrough additionally cools each of the metallic tubular stepped members 220 achieving a reduction of the jet engine's "heat signature" which is advantageous in military aircraft which are vulnerable to heat-seeking missiles.

Figure 16:
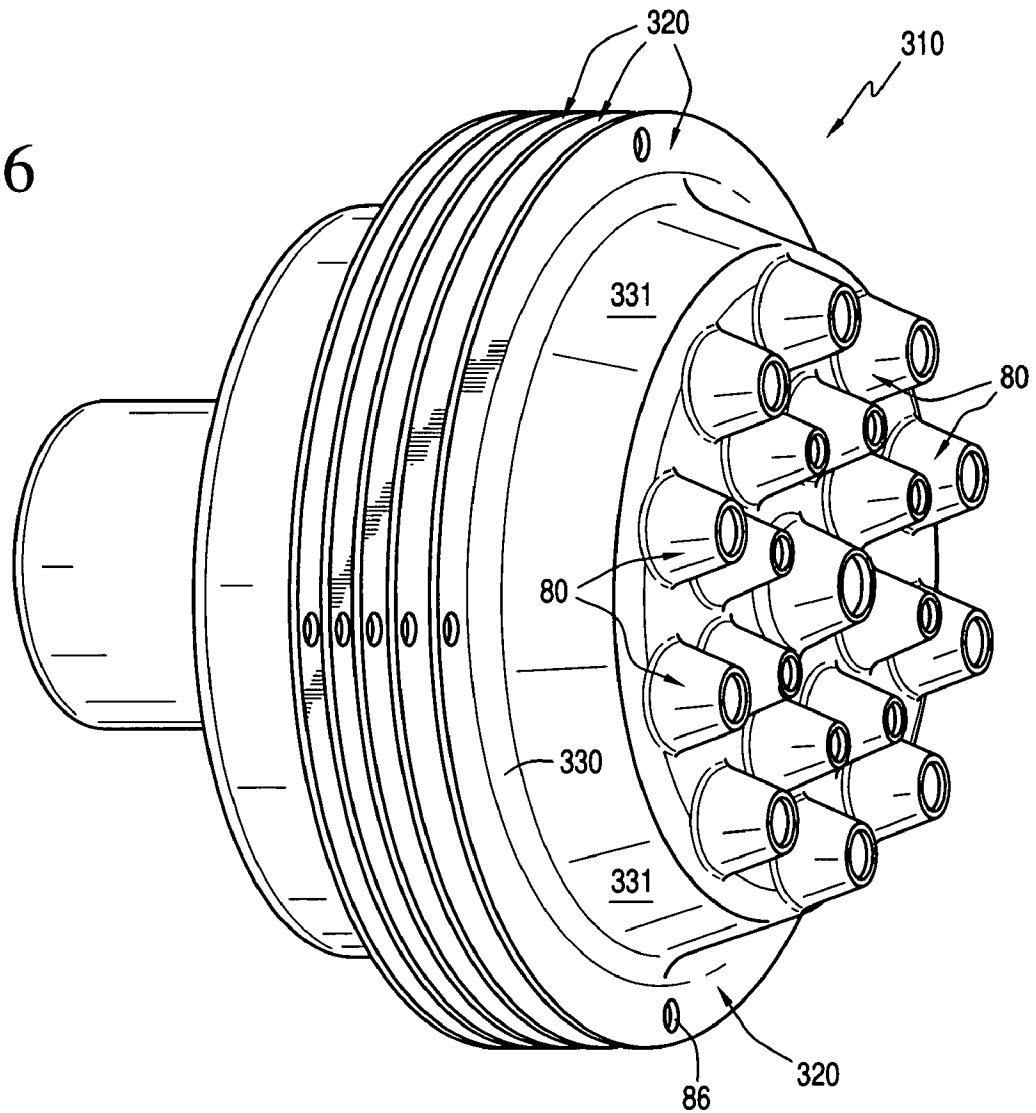
FIG. 16 is a perspective view of another venturi muffler of the invention, and illustrates a plurality of metallic stacked internested venturi-forming segments, each having a plurality of conical discharge nozzles with each pair of conical nozzles defining a substantially conical venturi passage.
Figure 17:
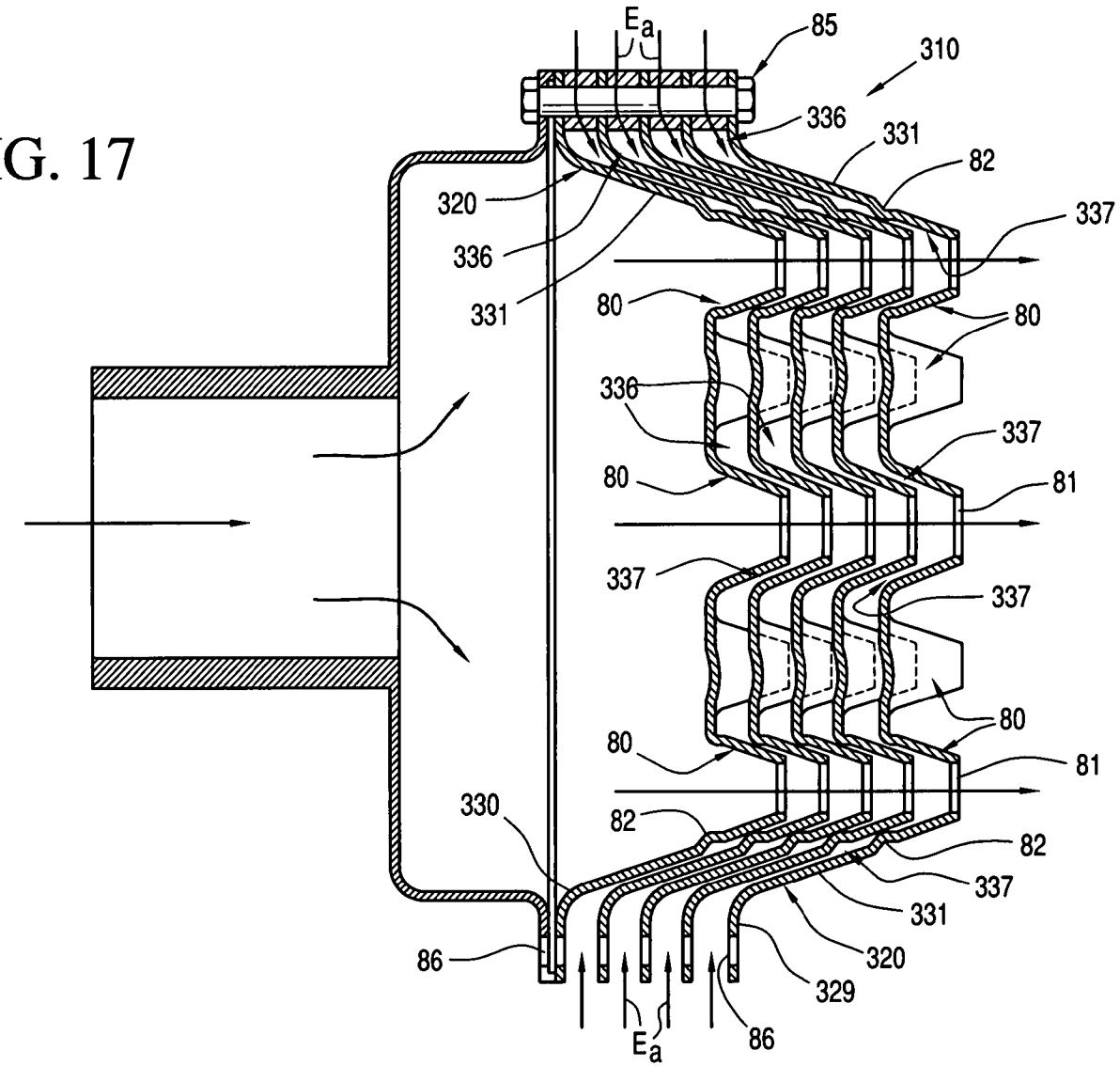
FIG. 17 is an axial cross-sectional view through the venturi muffler of FIG. 16, and more clearly illustrates the plurality of internested venturi nozzles and the flow path of exhaust gasses therethrough which draw outside air into the venturi passages.

Another venturi muffler constructed in accordance with this invention is illustrated in FIGS. 16 and 17 of the drawings and is generally designated by the reference numeral 310 with components thereof corresponding to the venturi muffler 10 being preceded by reference number "300. " The venturi muffler 310 is designed for use with smaller internal combustion engines, typical of which might be garden riding mowers. The venturi muffler 310 is formed from a plurality of stamped metallic tubular stepped members 320, each defined by an annular wall or flange 329, a peripheral shoulder or radius 330, a venturi-forming wall 331 and a plurality of conical exhaust discharge nozzles 80, each having a nozzle outlet 81 and projections or bumps 82 which maintain adjacent venturi forming walls 331 in spaced relationship to each other to define therebetween a plurality of conical venturi passages 337 through which exterior air Ea is drawn from atmosphere into each annular chamber 336, its associated venturi passage 337 and outwardly therefrom under the influence of exhaust gasses passing through the nested discharge nozzles 80. A plurality of nuts, bolts and washers, collectively identified by the reference numeral 85, are associated with holes or openings 86 in the annular walls 329 to maintain the annular walls 329 in spaced relationship so that exterior air Ea can be drawn therebetween to both cool the metallic tubular stepped members 320 and create a limited partial vacuum within the annular and conical chambers 336 and along the venturi passages 337.

Figure 18:
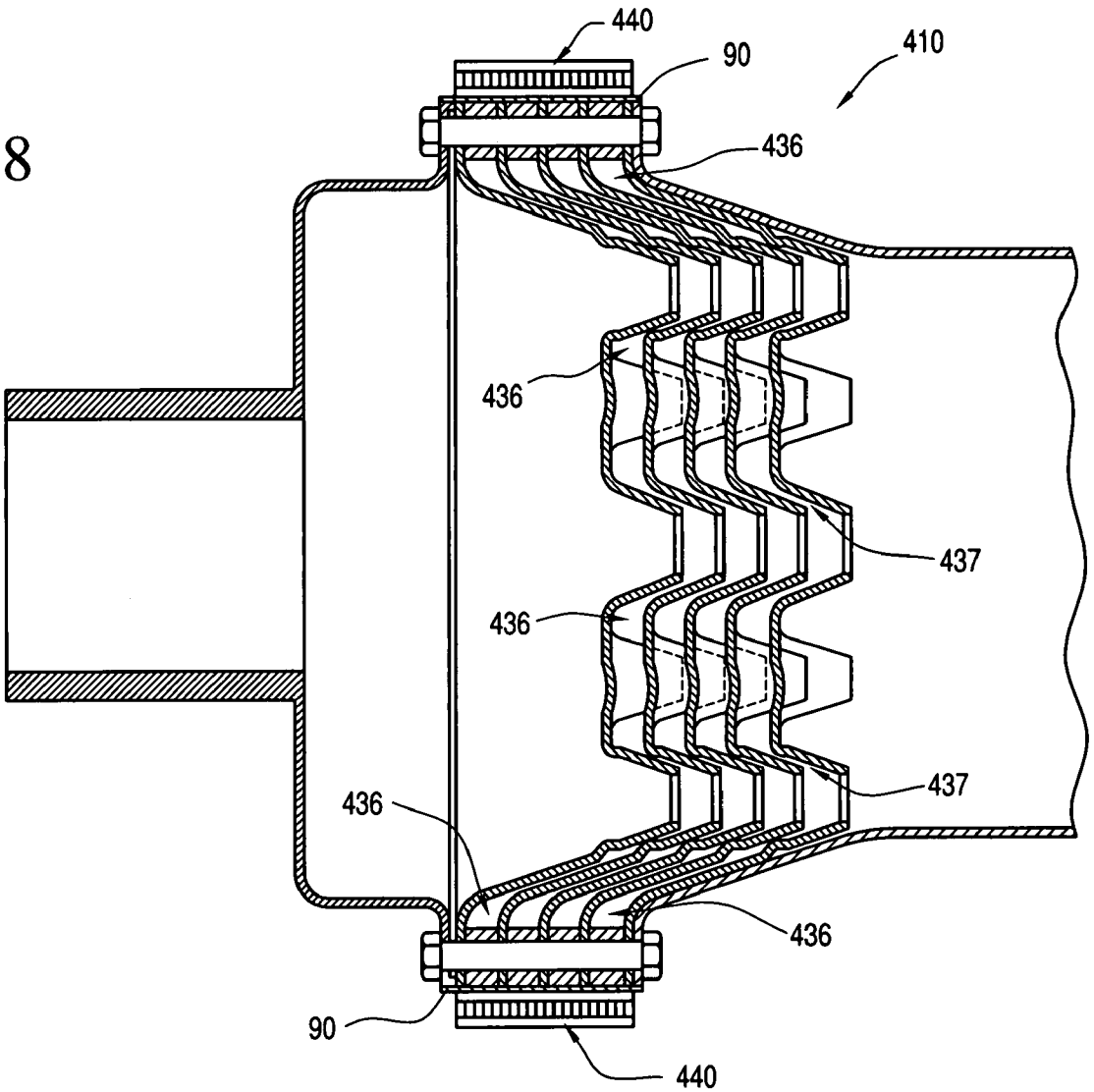
FIG. 18 is an axial cross-sectional view of a venturi muffler similar to the venturi muffler of FIG. 17, and illustrates an external cylindrical metallic sleeve preventing outside air from being introduced into the venturi passages to create a partial vacuum in outermost annular and inner conical vacuum chambers and thermo-electric modules on the exterior of the sleeve.

Another venturi muffler 410 is illustrated in FIG. 18 of the drawings and like reference numerals have been applied thereto preceded by "400. " The venturi muffler 410 includes a cylindrical outer highly heat-conductive metallic sleeve 90 which closes the annular chambers 436 to outside atmosphere precluding the introduction of exterior air Ea therein, as in the case of the venturi muffler 310. In this fashion, the annular chambers 436, as well as the conical partial vacuum chambers 436, are under a greater partial vacuum during the operation of an internal combustion engine with which the venturi muffler 410 is associated. Additionally, thermo-electric modules 440 substantially surround the entirety of the cylindrical heat-conductive sleeve 90 which absorb the heat of the exhaust gasses conducted or convected thereto thereby converting exhaust gas heat into thermo-electric power.

Figure 19:
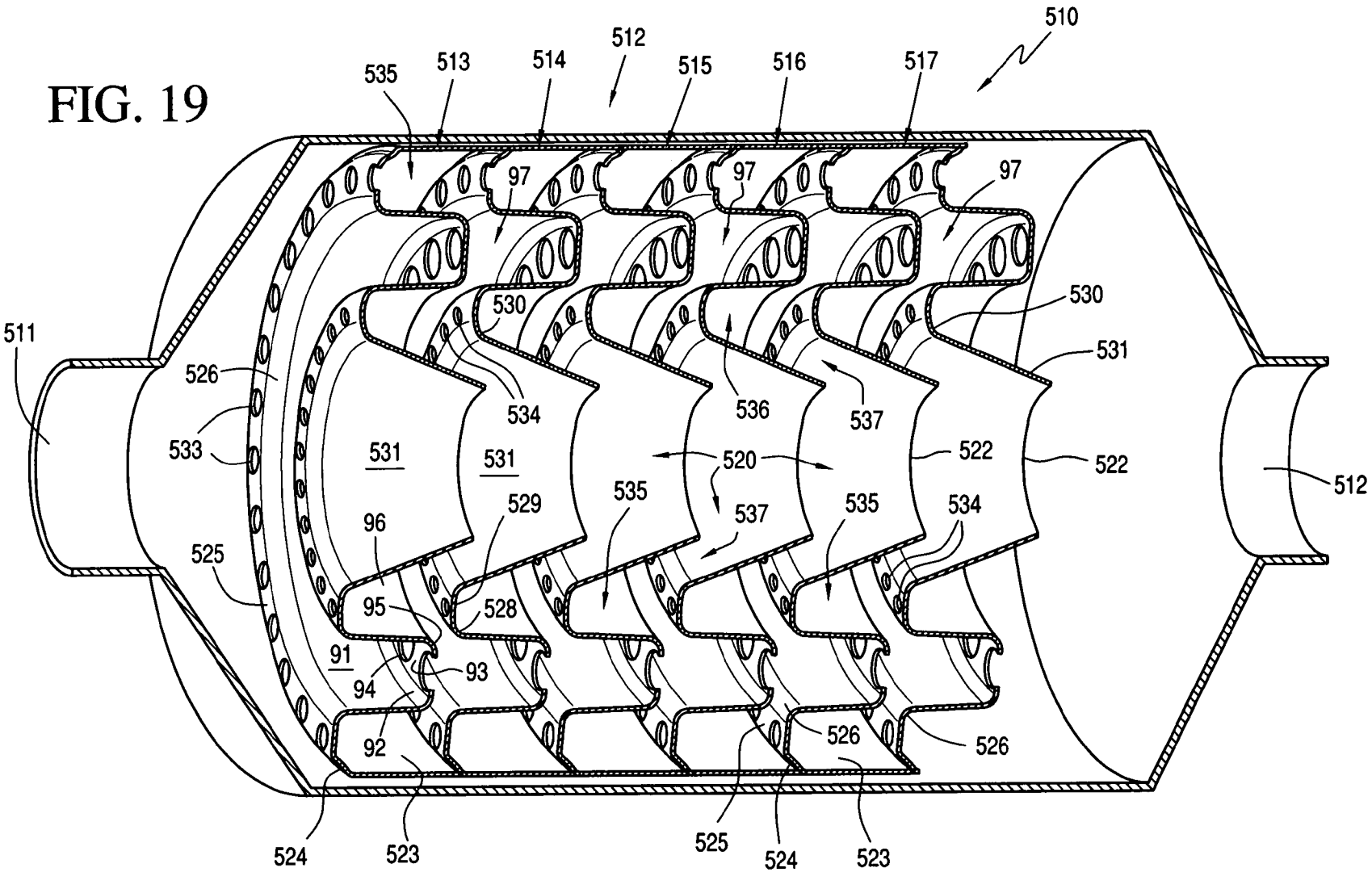
FIG. 19 is an axial cross-sectional perspective view of another venturi muffler, and illustrates venturi-forming segments with each adjacent pair of segments defining outermost, medial and innermost annular sound-reflective chambers with each of the latter opening through a venturi passage into a central exhaust flow passage.

Another venturi muffler 510 is illustrated in FIGS. 19 and 20 of the drawings and components corresponding to those of the venturi muffler 10 have been applied thereto preceded by numeral "500. " The venturi muffler 510 includes an exhaust inlet 511, an exhaust outlet 512 and therebetween a medial sound damping or sound attenuating section 512.

The sound damping section 512 is formed of five vacuum-forming/venturi-forming segments 513 through 517, each defined by a metallic highly heat-conductive tubular stepped member 520.

Each tubular step member 520 includes an outermost peripheral wall 523, a peripheral radius or shoulder 524, an outermost annular wall 525 having holes or openings 533 therein, and a shoulder or radius 526. Each tubular stepped member 520 also includes from an exhaust exit opening 522 a conical venturi-forming outlet wall 531, a peripheral radius or shoulder 530, an annular wall 529 having holes or openings 534 and a peripheral shoulder or radius 528. The shoulders or radii 526 and 528 are joined by an annular wall 91, a peripheral shoulder or radius 92, an annular wall 93 having holes or openings 94, a peripheral shoulder or radius 95 and an annular wall 96 collectively defining an intermediate annular reflective chamber 97 between all adjacent pairs of the tubular stepped members 520 thereby collectively defining between each pair of tubular step members 520 an outermost annular sound-reflective chamber 535, an intermediate sound-reflective chamber 97 and an innermost sound-reflective chamber 536 with the latter opening through an annular venturi passage 537 to create a partial vacuum in each of the annular chambers 535, 97 and 536.

Figure 13:
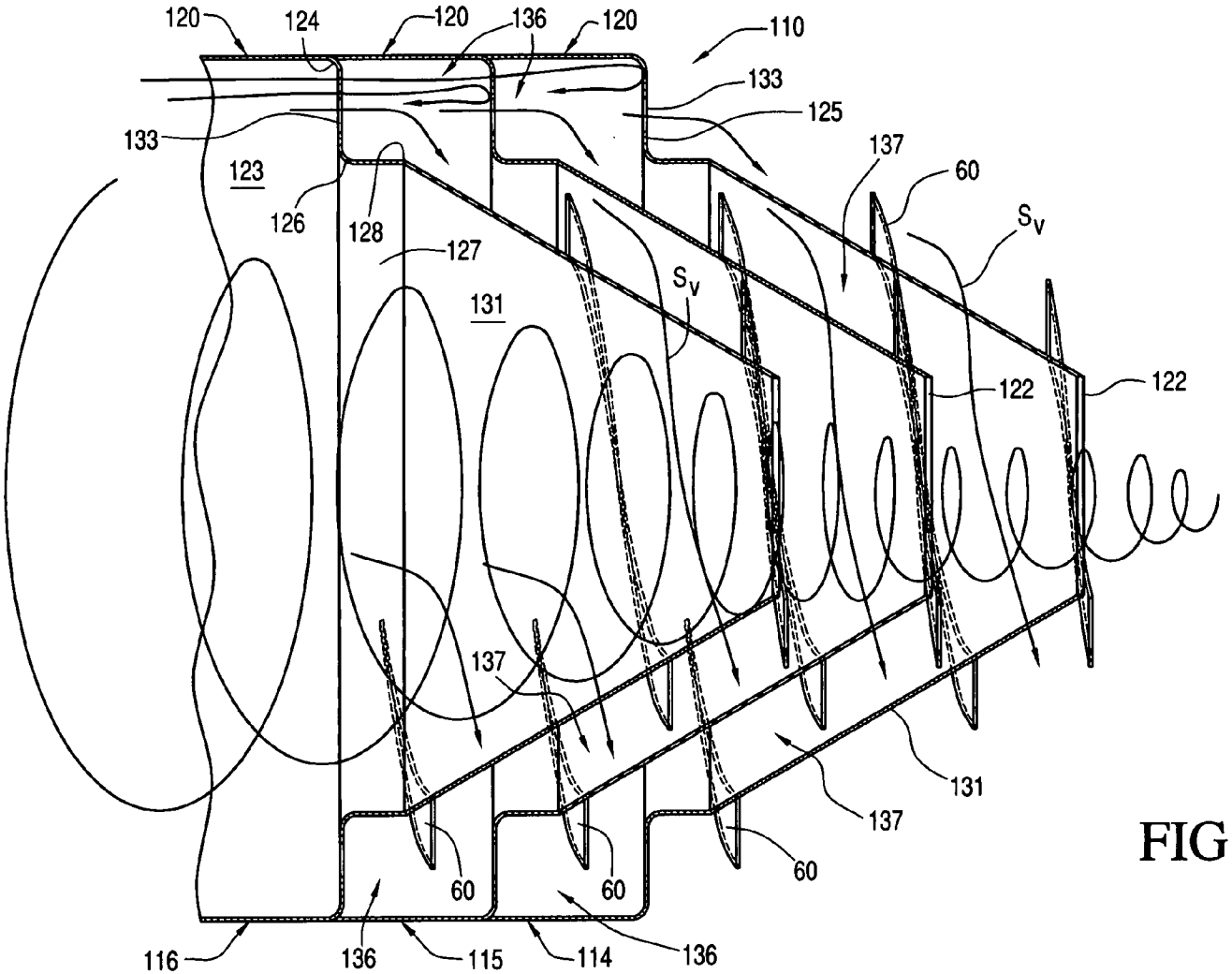
FIG. 13 is a fragmentary axial cross-sectional view of another venturi muffler, and illustrates three identical metallic, conical, stepped venturi-forming segments with each pair of segments defining an annular outermost chamber, a venturi passage, and fins or vanes within each venturi passage for additionally creating a vortex or spiral flow of exhaust gasses flowing therethrough.

Variations in the venturi mufflers heretofore described can be made in keeping with the present disclosure. As an example, the vanes or fins 60 of the venturi muffler 110 (FIGS. 13 and 14) can be utilized in the venturi muffler 210 of FIG. 15 which, as heretofore described, not only reduces noise, but reduces the "heat signature" of an associated jet engine of a jet aircraft. The vortex creates a spinning exhaust flow to disrupt on-coming sound waves that are traveling in a straight line from the engine such that the exhaust flow along the central axial flow passage is converted to spiral flow therethrough, as is illustrated in FIG. 13. The faster the jet aircraft flies, the faster the internal spin or vortex (Sv) that is influenced by outside air pressure being sucked and pushed into the engine muffler and centrifugally spun therethrough causing a reduction of pressure at the core of the spin. Therefore, the venturi muffler 210 can additionally dampen sound while also reducing the heat signature by providing each of the conical tapered outlet walls 231 with an external fin or vane, such as the fin or vane 60 of FIG. 13, resulting in the air flow diagrammatically illustrated therein.

Although a preferred embodiment of the invention has been specifically illustrated and described herein, it is to be understood that variations may be made in the apparatus without departing from the spirit and scope of the invention, as defined by the appended claims.

What is claimed is:

1. A venturi muffler comprising an exhaust flow path along which exhaust gasses pass in a direction from an inlet to an outlet, a plurality of substantially annular chambers disposed in axially contiguous relationship to each other in surrounding relationship to the exhaust flow path, means for effecting the introduction of a fluid medium into an upstream substantially annular chamber portion of each substantially annular chamber, means for defining a substantially annular fluid media discharge passage in fluid communication between each substantially annular chamber and the exhaust flow path in surrounding relationship to the exhaust flow path, each annular fluid media discharge passage including an annular converging venturi flow creating a flow path portion converging in the direction of the exhaust flow path whereby the flow of exhaust gasses create a partial vacuum in said plurality of substantially annular chambers to effect sound attenuation, and a plurality of second substantially annular chambers disposed in axially contiguous relationship to each other and in surrounding relationship to the first-mentioned plurality of substantially annular chambers, and said first-mentioned and second substantially annular chambers are not in fluid communication with each other.

2. The venturi muffler as defined in claim 1 wherein said fluid medium introduction means opens exteriorly of the muffler to atmosphere whereby the fluid medium is air introduced into each substantially annular chamber.

3. The venturi muffler as defined in claim 1 wherein said fluid medium introduction means are peripherally disposed holes opening into each substantially annular chamber portion in fluid communication with the fluid medium in the form of upstream exhaust gasses which are thereby introduced into each substantially annular chamber.

4. The venturi muffler as defined in claim 1 wherein the muffler is made of heat-conductive material including an exterior surface, and means upon said exterior surface for transforming heat to electricity.

5. The venturi muffler as defined in claim 1 including means for creating a vortex as the fluid media flows through said annular converging venturi flow creating discharge passage.

6. The venturi muffler as defined in claim 1 wherein each annular converging venturi creating discharge passage terminates at an annular discharge port at the exhaust flow path.

7. The venturi muffler as defined in claim 1 including a plurality of means along said exhaust flow path forming a plurality of exhaust gasses flow zones which successively compress and expand the exhaust gasses during flow thereof from the inlet to the outlet.

8. The venturi muffler as defined in claim 1 including means for placing at least selected ones of said second substantially annular chamber in fluid communication with selected ones of said first-mentioned substantially annular chambers whereby the flow of exhaust gasses create a partial vacuum in the selected ones of said second substantially annular chambers to effect further attenuation.

9. The venturi muffler as defined in claim 1 including means for placing said second substantially annular chambers in fluid communication with each other and with said inlet and outlet.

10. A venturi muffler comprising an exhaust flow path along which exhaust gasses pass in a direction from an inlet to an outlet, a plurality of substantially annular chambers disposed in axially contiguous relationship to each other in surrounding relationship to the exhaust flow path, means for effecting the introduction of a fluid medium into an upstream substantially annular chamber portion of each substantially annular chamber, means for defining a substantially annular fluid media discharge passage in fluid communication between each substantially annular chamber and the exhaust flow path in surrounding relationship to the exhaust flow path, each annular fluid media discharge passage including an annular converging venturi flow creating a flow path portion converging in the direction of the exhaust flow path whereby the flow of exhaust gasses create a partial vacuum in said plurality of substantially annular chambers to effect sound attenuation, and a plurality of second substantially annular chambers disposed in axially contiguous relationship to each other and in surrounding relationship to the first-mentioned plurality of substantially annular chambers, and said first-mentioned and second substantially annular chambers are not in fluid communication with each other. a plurality of second substantially annular chambers disposed in axially contiguous relationship to each other and in surrounding relationship to the first-mentioned plurality of substantially annular chambers, said first-mentioned and second substantially annular chambers are not in fluid communication with each other, and means for placing said second substantially annular chambers in fluid communication with each other and with said inlet and outlet.

11. The venturi muffler as defined in claim 1 wherein each substantially annular chamber and annular fluid media discharge passage is defined by two substantially identical annular segments.

12. The venturi muffler as defined in claim 1 wherein each substantially annular chamber and annular fluid media discharge passage is defined by two substantially identical annular segments, and each substantially identical annular segment is defined in the direction of exhaust flow by at least a peripheral wall, an annular wall and a conical wall.

13. The venturi muffler as defined in claim 1 wherein each substantially annular chamber and annular fluid media discharge passage is defined by two substantially identical annular segments, each substantially identical annular segment is defined in the direction of exhaust flow by at least a peripheral wall, an annular wall and a conical wall, and means for unitizing said segments to each.

14. The venturi muffler as defined in claim 1 wherein each substantially annular chamber and annular fluid media discharge passage is defined by two substantially identical annular segments, each substantially identical annular segment is defined in the direction of exhaust flow by at least a peripheral wall, an annular wall and a conical wall, means for unitizing said segments to each other, and said unitizing means is a peripheral weld between said peripheral walls.

15. The venturi muffler as defined in claim 1 wherein each substantially annular chamber and annular fluid media discharge passage is defined by two substantially identical annular segments, each substantially identical annular segment is defined in the direction of exhaust flow by at least a peripheral wall, an annular wall and a conical wall, means for unitizing said segments to each other, and said unitizing means is a tubular sleeve in intimate surrounding gripping relationship to said annular segment peripheral walls.

16. The venturi muffler as defined in claim 1 including a plurality of third substantially annular chambers disposed in axially contiguous relationship to each other and in exterior surrounding relationship to the second plurality of substantially annular chambers.

17. A venturi muffler comprising an exhaust flow path along which exhaust gasses pass between an inlet and an outlet, a plurality of segments each including an outermost substantially peripheral wall, a medial substantially annular wall and an innermost peripheral wall converging in the direction of exhaust gas flow from said inlet to said outlet, means for uniting said plurality of segments into a substantially rigid muffler, said uniting means being a continuous peripheral weld between said outermost substantially peripheral walls of axially adjacent segments, said outermost substantially peripheral walls collectively defining a substantially contiguous outer wall of said muffler, and said innermost peripheral walls collectively defining said exhaust gasses flow path.

18. The venturi muffler as defined in claim 17 including means upon an exterior surface of at least one of said outermost substantially peripheral walls for converting the heat from exhaust gasses into electricity.

19. The venturi muffler as defined in claim 17 including catalytic material carried by at least selected portions of selected ones of said plurality of segments.

20. The venturi muffler as defined in claim 17 wherein a substantially annular chamber is defined between the outermost peripheral wall and medial annular wall of adjacent segments, and a venturi passage is defined between the converging innermost peripheral walls of adjacent segments in fluid communication with each annular chamber whereby a partial vacuum is created in each annular chamber as exhaust gasses pass from the inlet to the outlet.

21. The venturi muffler as defined in claim 17 wherein said uniting means are welds.

22. The venturi muffler as defined in claim 17 wherein each converging innermost peripheral wall is spanned by an end wall having a plurality of holes therein.

23. The venturi muffler as defined in claim 17 wherein each substantially annular medial wall has a plurality of holes therein.

24. The venturi muffler as defined in claim 17 including thermo-electric means upon an exterior surface of at least one of said outermost substantially peripheral walls for converting heat from exhaust gasses into electricity.

25. The venturi muffler as defined in claim 17 including catalytic material carried by at least selected portions of selected ones of said plurality of segments.

26. The venturi muffler as defined in claim 21 including a coating of catalytic material upon at least selected interior surface portions of selected ones of said plurality of segments.

27. The venturi muffler as defined in claim 17 wherein each converging innermost peripheral wall is spanned by an end wall having a plurality of holes therein.

28. The venturi muffler as defined in claim 17 wherein each substantially annular medial wall has a plurality of holes therein.

* * * * *